US012434128B2

(12) United States Patent
Landry

(10) Patent No.: US 12,434,128 B2
(45) Date of Patent: Oct. 7, 2025

(54) SYSTEM AND METHODS FOR GAME PLAY

(71) Applicant: Susan M. Landry, Campbell, CA (US)

(72) Inventor: Susan M. Landry, Campbell, CA (US)

( * ) Notice: Subject to any disclaimer, the term of this patent is extended or adjusted under 35 U.S.C. 154(b) by 658 days.

(21) Appl. No.: 17/817,564

(22) Filed: Aug. 4, 2022

(65) Prior Publication Data

US 2023/0149795 A1 May 18, 2023

Related U.S. Application Data

(60) Provisional application No. 63/279,968, filed on Nov. 16, 2021.

(51) Int. Cl.
*A63F 3/00* (2006.01)

(52) U.S. Cl.
CPC ..... *A63F 3/00097* (2013.01); *A63F 3/00694* (2013.01); *A63F 2003/00182* (2013.01); *A63F 2003/0063* (2013.01); *A63F 2003/00738* (2013.01); *A63F 2003/00747* (2013.01)

(58) Field of Classification Search
CPC ..... A63F 3/00097; A63F 3/00694; A63F 2003/00182; A63F 2003/0063; A63F 2003/00738; A63F 2003/00747; A63F 2001/0441; A63F 2003/00359; A63F 2003/00583; A63F 2003/00946; A63F 2011/0076; A63F 3/00574; A63F 2003/00009; A63F 2003/00757; A63F 2009/1022; A63F 2009/1033; A63F 2250/1036; A63F 2250/1057
USPC ..... 273/275
See application file for complete search history.

(56) References Cited

U.S. PATENT DOCUMENTS 4,034,986 A * 7/1977 Weidner ..... A63F 3/0457 273/459
5,427,379 A * 6/1995 Lee ..... A63F 9/0803 273/281
2005/0104291 A1* 5/2005 Levinson ..... A63F 3/00097 273/258

* cited by examiner

*Primary Examiner* — Michael C Grant
(74) *Attorney, Agent, or Firm* — PERKINS COIE LLP

(57) ABSTRACT

Players attempt to be the first person to move from the start of the board puzzle piece to the end of board. The game is played in at least three phases, with each phase utilizing different game pieces. Phase one consists of creating a puzzle pattern by placing background puzzle pieces on the puzzle game board and connecting background puzzle pieces already on the board. Phase two consists of placing color overlay puzzle pieces on top of the background puzzle pieces that make up the puzzle pattern. Phase three is accomplished by each player selecting a playing card and then either strategically migrating their creature by moving contiguously between the creature spots or by jumping from a color overlay creature spot to a different color overlay creature spot, as described on the playing card selected. The game ends when a player moves off the end of board.

5 Claims, 19 Drawing Sheets

SYSTEM AND METHODS FOR GAME PLAY

TECHNICAL FIELD

This disclosure relates to educational and entertainment games.

The present invention relates to games, more particularity to various embodiments of a competitive puzzle and board game for multiple players that challenges players to construct puzzles.

BACKGROUND

Games teach children and adults skills that then can be used in real life scenarios. These games provide an opportunity to develop logic skills and motor skills. Games come in many forms, and some examples include puzzles, board games, card games, and lawn games.

Games also provide us with education and entertainment as we learn the consequences of the actions of the characters. Additionally, we are engaged and entertained as we become invested in the characters and their specific trials and triumphs.

Background Games:

Puzzle—Pieces together create a picture.

Pinochle—Different phases within the game, strategy, and luck of the draw.

Dominoes—Pieces laid down in lines. To create a line, after the first piece, a piece must match one already on the board. In certain situations, two pieces can be connected to one puzzle piece, creating different lines of pieces.

Connect the Dots—Winner has the most squares with their name. Can create long runs of squares by using contiguous lines, break in the contiguous path means less squares won per person.

Horseshoes—Closest and farthest count, a way to measure.

Chess—Thinking several steps ahead, position pieces to set up future play, moving forward, backwards and side to side.

Chutes & Ladders—Jumping from across rows.

Blackjack—Counting cards.

Blockus—Strategic play, geometric pieces, each piece is a different configuration of 1,2,3,4 or 5 squares. Pieces left over have points. Lowest number of points wins. Each player has a quadrant; person who connects to other quadrant gets credit.

Legos—Various puzzle pieces that connect in a variety of ways to make different shapes, buildings, or tangible things.

SUMMARY OF THE INVENTION

This geometric multi-dimensional puzzle game is centered around the directional piece, consisting of one junction and a combination of connectors, arrowheads, and arrowfeathers. The connectors represent the four points on a compass: north, south, east, and west, and are located 90 degrees from each other, radial to the junction. Each directional piece has at least one arrowhead or one arrowfeather and up to four arrowheads or arrowfeathers. The three-dimensional directional pieces have additional connectors projecting from the center either up or down. There are 23 two-dimensional directional pieces and 184 three-dimensional directional pieces. Directional pieces represent every configuration and combination of arrowheads and arrowfeathers based on north, south, east, west, up, and down. Arrowheads connect to arrowfeathers and, when placed on the gameboard, create puzzle patterns. A combination of the indentation on the underside of the directional piece and the knob on the gameboard locks the alignment of the directional pieces.

The game includes various modes of play/formats depending on level of expertise or preference. In some embodiments, players first build out a complete puzzle pattern and then select instruction cards, from which they migrate their creature figurines starting from a beginning puzzle piece location. The winner is the first player to land on the end puzzle piece location. In some embodiments, players strategically place their directional pieces on the gameboard, and the player with the fewest remaining pieces wins.

Each directional piece configuration represents a compass (north, south, east, west) combined with a tangential analogy to computer code, 1s & 0s, or on & off, and the quantum idea that you can be both a 1 and a 0 at the same time.

The geometric multi-dimensional thinking puzzle game apparatus 50 is solution oriented critical thinking enhancement tool, which operates by challenging players in a strategic way through a process to achieve the goal of solving the puzzle, which is created by connecting various directional pieces 200 in different puzzle pattern 500 configurations with or without placing directional pieces 200 on the gameboard 400.

The puzzle game apparatus 50 is designed to be played in a variety of options with or without the gameboard 400. The gameboard 400 options provide for competitive play by two or more players in different phases, each phase utilizing a plurality of the game apparatus 50 components, including, but not limited to, using the directional pieces 200 in the organization trays 300 to create a puzzle pattern 500 with the players then drawing instruction cards 700 that direct how to migrate their creatures 600 around the puzzle pattern 500. The levels of play include beginner, intermediate, advanced, expert, and genius.

Beginner expertise play can be with or without the gameboard 400 where the directional pieces 200 are placed on a flat surface, and directional pieces 200 are randomly placed end to end by joining together the notch of an arrowhead 120 with the notch of an arrowfeather 130. This can be played by one or more players.

For the intermediate, advanced, and expert levels of expertise, players attempt to be the first person to migrate from the 'START OF PUZZLE' **200*a* directional piece to the 'END OF PUZZLE' 200*f* directional piece. This option for the game is played in a minimum of two phases. Phase One consists of creating a puzzle pattern 500 by placing various directional pieces 200 on the puzzle gameboard 400, by connecting each directional piece 200 to one already on the board. They connect to each other end-to-end by aligning the notch of an arrowhead 120 to the notch of an arrowfeather 130. Phase Two is accomplished by migrating creatures 600 around the puzzle pattern 500 upon selection of an instruction card 700. Taking turns, each player strategically migrates their creature either by 'moving contiguously' from the junction 102 of one directional piece 200 to the junction 102 on a different directional piece 200 or by 'jumping' from a specifically colored junction 102 of a directional piece 200 to a different junction 102 of the same color, as described on the instruction card 700 selected. This version of the game ends when a player is stationed on the 'END OF PUZZLE' directional piece 200*f*. The same gameboard can be utilized for replay of Phase Two. Creatures 600 go back to 'START OF PUZZLE' directional piece 200*a*** and continue to play as described for Phase Two. Each time the same puzzle pattern 500 is played with the instruction cards 700, creatures 600 will migrate on different paths of travel. The outcome could be that the winner is the same or, more likely, different. Another option is to restart Phase One and create a new puzzle pattern 500 on the same gameboard 400 where the directional pieces 200 are laid out in a different configuration. Then the order of play is similar as described for Phase Two.

Other versions of play include utilizing an independent diagram depicting a pre-determined puzzle pattern 500 as shown in FIG. 36. The goal is for the player to lay out the directional pieces 200 without a time deadline on the gameboard 400 corresponding to the configuration depicted on the independent, pre-determined diagram of a puzzle pattern 500. The player whose puzzle pattern 500 correctly placed the directional pieces 200 on the gameboard 400 wins. In case of a tie, the players are then timed while creating the same puzzle pattern 500 again. With timed play, the fastest player to create the puzzle pattern 500 that is consistent with the pre-determined puzzle pattern 500 wins.

The object of the genius level of play is to be the player with the fewest directional pieces 200 remaining when no more directional pieces 200 can be placed on the play space knobs 420 on the gameboard 400. Each player is provided with a different color set of similar directional pieces 200 in similar organization trays 300, each organization tray 300 consisting of the same number and same directional piece configurations. Players take turns strategically placing their color directional pieces 200 on the gameboard 400. After the possible configurations of directional pieces 200 are placed on the play space puzzle knobs 420 on the gameboard 400, the player with the least number of directional pieces 200 and the least number of arrowheads 120 and arrowfeathers 130 remaining wins.

DETAILED DESCRIPTION

Figure 1:
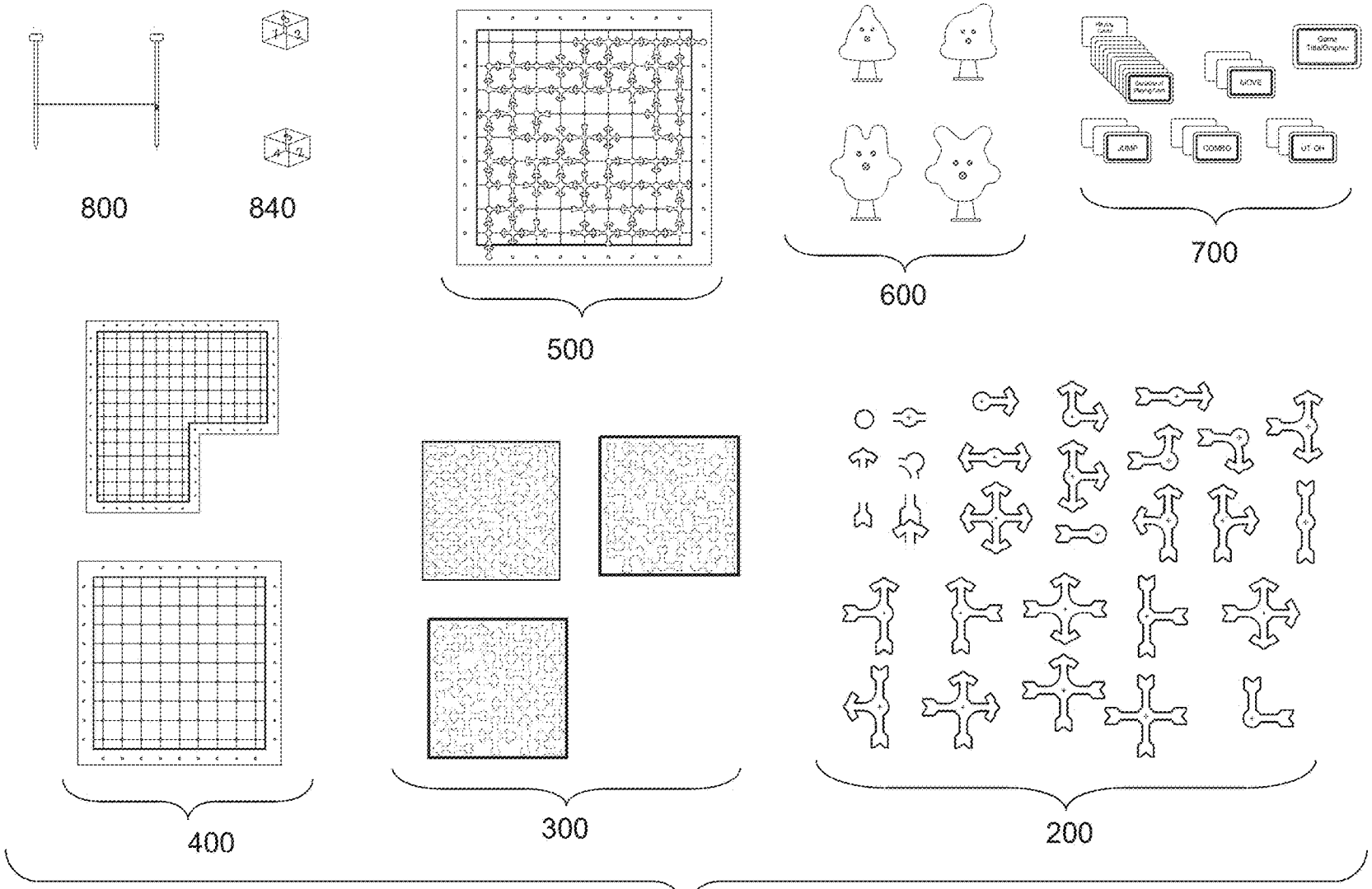
FIG. 1 is a perspective view of the puzzle game apparatus according to this present invention.

Similar reference characters denote corresponding features consistently throughout the attached drawings.

Referring to FIG. 1, the present invention comprises a puzzle game apparatus 50, which in a preferred embodiment, includes a plurality of directional pieces 200, at least one organization tray 300, as least one gameboard 400, at least one solved puzzle pattern 500, creatures 600, measuring compass 800, dice 840, and instruction cards 700.

An electronic version of the present invention comprises a plurality of three-dimensional directional pieces, which differ from the two-dimensional playing directional pieces.

This multi-dimensional geometric puzzle game apparatus 50 can be played by one, two, or more players in a multitude of options, variations, and different levels of expertise. The levels include a beginner level, intermediate level, advanced level, expert level, and genius level.

Beginner level of play includes utilizing only the directional pieces 200, where pieces are laid on a flat surface and the directional pieces 200 are connected in a manner similar to building blocks. The object of this level of play is to teach how pieces connect and to create various patterns. There does not necessarily have to be a winner. Intermediate, advanced, and expert levels of expertise utilize the directional pieces 200, the organizational trays, the gameboard 400, instruction cards 700, the compass 800, and the dice 840.

Intermediate, advanced, and expert levels have two phases of playing. The object of these levels is to be the first player to migrate their creatures 600 from the 'START OF PUZZLE' 200*a* piece to the 'END OF PUZZLE' 200*f* piece. There are a multitude of play options and variations of the game, each creating puzzle patterns 500 by placing directional pieces 200 on a puzzle knob 420 on the gameboard 400. Intermediate, advanced, and expert levels in Phase One play begin by determining the order of play, with each player taking turns selecting a directional piece 200 in the organization trays 300 and placing the directional piece 200 on a puzzle knob 420 on the gameboard 400 creating a puzzle pattern 500. Once there are no more locations where a player can add a directional piece 200 to the gameboard 400, Phase Two begins. During Phase Two, a player selects an instruction card 700 and then migrates their creature 600 as described on the card, around the puzzle pattern 500 from the 'START OF PUZZLE' 200*a* directional piece to the 'END OF PUZZLE' 200*f* directional piece. The player that wins is the first to land on the 'END OF PUZZLE' 200*f* directional piece. Intermediate level of play includes utilizing the gameboard 400, a limited plurality of directional pieces 200, creatures 600, and a limited plurality of instruction cards 700. Advanced level of play includes utilizing the gameboard 400, the entire plurality of directional pieces 200, creatures 600, and a specific plurality of instruction cards 700. Expert level play includes utilizing the gameboard 400, the entire plurality of directional pieces 200, creatures 600, and the entire plurality of instruction cards 700.

The genius level of expertise utilizes the entire plurality of directional pieces 200 and the gameboard 400. The object of the genius level play is to be the player with the fewest directional pieces 200 remaining when no more directional pieces 200 can be placed on the play space knobs 420 on the gameboard 400. Each player is provided with a different color set of similar directional pieces 200 in similar organization trays 300, each consisting of the same number and same directional piece configurations. Players take turns strategically placing their color directional pieces 200 on the gameboard 400. After all the possible directional pieces are placed on the play space puzzle knobs 420 on the gameboard 400, the player with the least number of directional pieces 200 and the least number of arrowheads 120 and arrowfeathers 130 remaining wins. Each remaining directional piece 200 counts as two points and each arrowhead 120 or arrowfeather 130 counts as one point.

A plurality of directional pieces 200 embodiments are multi-dimensional, and each comprises a unique configuration. Directional pieces 200 are specially configured to connect to each other and to connect to the gameboard puzzle knobs 420. Directional piece components 200 include only one junction 102, a plurality of connectors 142, a plurality of arrowheads 120, and a plurality of arrowfeathers 130, and they can vary in color. Attached to the junction 102, each directional piece 200 has a minimum of one connector 142 and a minimum of at least one arrowhead 120 or one arrowfeather 130. A directional piece 200 may have more than one arrowhead 120, may have more than one arrowfeather 130, or may have a combination of arrowheads 120 and arrowfeathers 130. Each directional piece 200 has an indentation 112 on the underside of the junction 102 that fits over the raised puzzle knob 420 on the puzzle gameboard 400. FIGS. 2 through 30 depict embodiments of the plurality of directional piece 200 configurations. Connectors 142/144 are located 90 degrees from each other, radial to the junction 102. The connectors on two-dimensional directional pieces 200 represent the four points on a compass: north, south, east, and west. Each directional piece 200 embodiment has at least one arrowhead 120 or one arrowfeather 130 and can have up to four arrowheads 120 or arrowfeathers 130 in any combination. The three-dimensional directional pieces 200 have additional connectors projecting up from the junction 102 or down from the junction 102. There are 23 two-dimensional directional pieces and 184 three-dimensional directional pieces. The plurality of directional pieces 200 represents every configuration and combination of arrowheads 120 and arrowfeathers 130 based on north, south, east, west, up, and down.

Figure 2A:
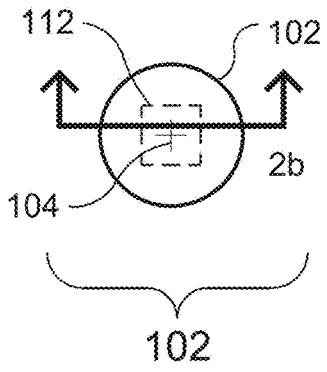
FIG. 2*a* is a top plan view of the junction of the directional piece embodiment.
Figure 2B:
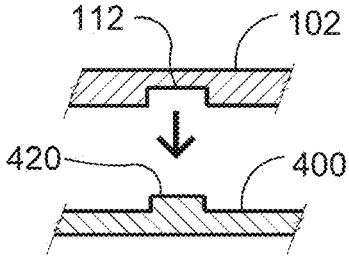
FIG. 2*b* is a section view of the junction of a directional piece embodiment depicting the indentation on the underside and a section view of the gameboard's puzzle knob depicting how the two connect on the gameboard.

The junction 102 is the location where the creature 600 rests during play on a puzzle pattern 500. FIG. 2*a* is a top plan view of the junction 102 of the directional piece 200. The underside of the junction 102 has an indentation 112 that links with the puzzle knob 420 on the gameboard 400 to constrain the directional piece 200, preventing shifting during play creating a puzzle pattern 500 or when migrating creatures 600 around the puzzle board 400. A directional piece 200 may also be linked to a puzzle knob 420 by a magnet. A plurality of connectors 140 are attached to the junction 102 on varying sides. Connectors 140 are located between the junction 102, a plurality of arrowheads 120 and a plurality of arrowfeathers 130. FIG. 2*b* is a section view of the junction 102 of a directional piece 200 embodiment depicting the indentation on the underside and a section view of the gameboard 400 puzzle knob 420 depicting how the two connect on the gameboard. Puzzle knobs 420 may be fastened onto the game board or may be independent detachable pieces that fit into indentations on the game board.

Figure 3:
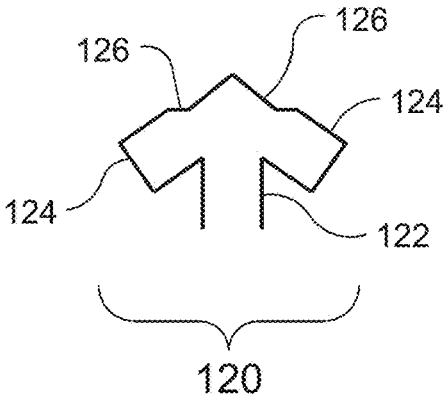
FIG. 3 is a top plan view of the arrowhead 120 part of a directional piece embodiment.

An arrowhead 120 part of the directional pieces 200 embodiment is a polygon shape that consists of a main section 122 and two flared projections 124. FIG. 3 is a top plan view of the arrowhead 120 part of a directional piece embodiment 200. The main section 122 of the arrowhead 120 attaches to a plurality of connectors 140. An arrowhead 120 flared projection 124 extends on two sides of the main section 122. The top of the flared projections 124 angles toward the center forming the point of the arrowhead 120 and has a notched end 126. When the game is played on the gameboard 400 and with the creatures 600, the arrowhead 120 points in the direction a creature 600 moves 'OUT' from the junction 102 of the directional piece 200 onto a different contiguously placed directional piece 200. A creature 600 can only move 'OUT' of a junction 102 through an arrowhead 120, and only if the arrowhead is connected to an arrowfeather 130. Arrowheads 120 point forward and allow a creature to move 'OUT' from the junction 102 of a directional piece 200. Moving 'OUT' allows a creature 600 to move contiguously from the current directional piece 200 where they are located to an adjacently connected directional piece 200. A creature 600 can only move 'OUT', e.g., move forward, if the current directional piece 200 connects to an arrowfeather 130 of an adjacent directional piece 200. If there is no connecting arrowfeather 130, a creature 600 cannot move 'OUT', e.g., move forward. Several directional pieces 200 do not contain an arrowhead 120, and a creature 600 cannot 'MOVE' contiguously forward 'OUT' of that directional piece. The only way a creature 600 can migrate 'OUT' of a directional piece 200 without an arrowhead 120 is to 'JUMP' from their current location to a different directional piece 200 of the same color.

Figure 4:
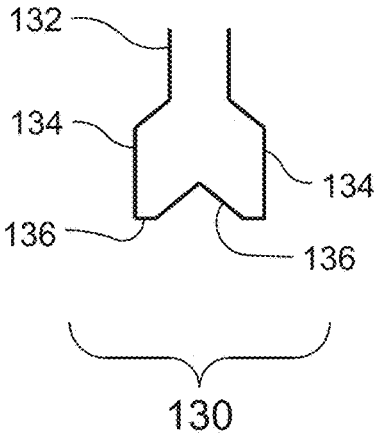
FIG. 4 is a top plan view of the arrowfeather 130 part of a directional piece embodiment.

An arrowfeather 130 part of the directional pieces 200 embodiment is a polygon shape that consists of a main section 132 and two projections 134. FIG. 4 is a top plan view of the arrowfeather 130 part of a directional piece embodiment 200. An arrowfeather 130 part of the directional pieces 200 is a polygon shape that consists of a main section 132 and two projections 134. The main section 132 of the arrowfeather 130 attaches to a plurality of connectors 140. An arrowfeather 130 has two sides and a bottom section. The top of the notched end 136 angles toward the center of the main section 132 and points in the direction the creature 600 can move 'IN' to a junction 102. The bottom part of the projection of the directional piece 200 has a notched end 136. A creature 600 can only move 'IN' to a junction 102 through an arrowfeather 130 and only if the arrowfeather 130 is connected to an arrowhead 120. Arrowfeathers 130 point 'IN' to the junction 102 of a directional piece 200. A creature 600 can only move 'IN' to the junction 102 of a directional piece 200 by passing through an arrowfeather 130. Only when an instruction card 700 directs a player to MOVE' back can a creature 600 leave a junction 102 through an arrowfeather 130. Several directional pieces do not contain an arrowfeather 130, and a creature 600 cannot 'MOVE' contiguously into an adjacent directional piece 200. The only way a creature can migrate 'IN' to a junction 102 of a different directional piece 200 without an arrowfeather 130 is to 'JUMP' 600 from their current location to the junction 102 of a different directional piece 200 of the same color.

Figure 5:
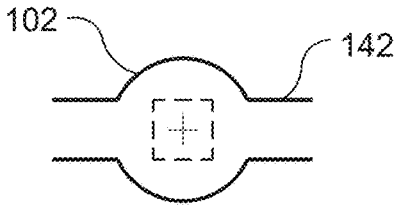
FIG. 5 is a top plan view of the junction with straight connectors 142 projecting off the sides.
Figure 6:
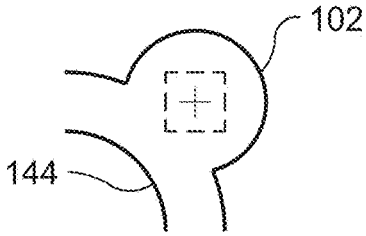
FIG. 6 is a top plan view of the junction with curved connectors 144 projecting off the sides.

The connector 140 part of the directional pieces 200 is either straight 142 or curved 144. Connectors radiate from the junction 102 at 90-degree angles to each other. Connectors 140 join the arrowhead 120 and arrowfeathers 130 at the junction 102. FIG. 5 is a top plan view of the junction 102 with straight connectors 142 projecting off two sides. FIG. 6 is a top plan view of the junction 102 with curved connectors 144 projecting off two sides. Curved connectors are only between an arrowhead 120 and an arrowfeather 130.

Figure 7:
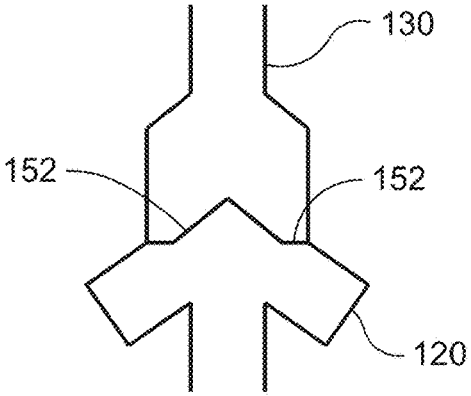
FIG. 7 is a top plan view depicting the connection of the notched end of an arrowhead 120 to the notched end of an arrowfeather 130.

Each directional piece 200 configuration embodiment has only one junction 102, at least one connector 140, and at least one arrowhead 120 or arrowfeather 130. When directional pieces 200 are placed together, the arrowhead notch 126 can align with the arrowfeather notch 136. When playing on the gameboard 400, connecting the notches 152 of different directional pieces 200 creates a puzzle pattern 500 and provides a path of contiguous migration for the creature 600 to move around the gameboard 400. A creature 600 can only move 'OUT' of the junction 102 of a directional piece 200 contiguously through an arrowhead 120 and only if connected contiguously to an arrowfeather 130. A creature 600 can only move 'IN' to the junction 102 of a directional piece through an arrowfeather 130 and only if connected contiguously to an arrowhead 120. FIG. 7 is a top plan view depicting the connection of the notched end 126 of an arrowhead 120 to the notched end 136 of an arrowfeather 130. The notches 152 constrain movement between two pieces, keeping them from shifting when creatures 600 migrate around the puzzle pattern.

Directional pieces 200 are stored in organization trays 300 which can include different directional pieces 200 depending on the expertise of the game being played. Beginner level organization trays 300 include different colors of every configuration of directional pieces 200 that have a minimum of one arrowhead 120 and a minimum of one arrowfeather 130. Directional pieces 200 can include more than one arrowhead 120 and arrowfeather 130. Intermediate and advanced level organization trays 300 include different colors of only the directional pieces 200 that consist of a minimum of one arrowhead 120 and a minimum of one arrowfeather 130. Directional pieces 200 can include more than one arrowhead 120 and arrowfeather 130. Multiple pieces of a similar configuration can be included in these organization trays 300. Expert level puzzle trays include all directional pieces in different colors. Genius level organization trays 300 are distinguished by colors, with each set of organization trays 300 including the same directional piece 200 configurations. Multiple pieces of a similar configuration can be included if each color of organization trays 300 contains the same number of directional pieces 200. Each directional piece embodiment 200 is configured differently. FIG. 8 through FIG. 30 are a plurality of various directional piece embodiments 200, each uniquely configured. Each directional piece embodiment 200 consists of only one junction 102, connectors 140 attached to the junction 102, each connecting to a combination of arrowheads 120 and arrowfeathers 130. The unique configurations of directional pieces are described by the quantity of arrowheads 120 designated as 'OUT' and arrowfeathers 130 designated as 'IN'. Except for the 'start of puzzle' piece **200*a* and the 'end of puzzle' piece 200*f*, each other directional pieces 200 is placed on the gameboard 400 by connecting to a directional piece 200 already on the gameboard 400**.

Figure 8:
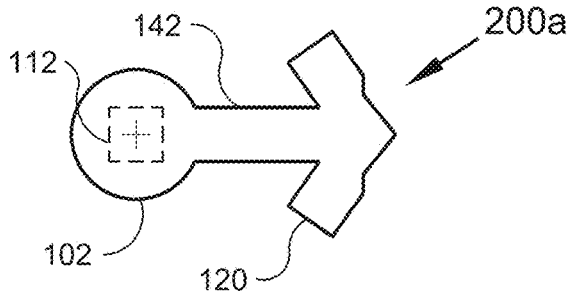
FIG. 8 is a top plan view of the '0–IN+1–OUT~START OF BOARD' directional piece embodiment.

FIG. 8 is a top plan view of the directional piece 200 embodiment described as '0–IN+1–OUT~START OF PUZZLE' **200*a*, consisting of a junction 102 and a straight connector 142 with an arrowhead 120. When play occurs on the gameboard 400, the 'START OF PUZZLE' directional piece 200***a* is the first to be placed on the puzzle gameboard 400 and can be placed anywhere on an outside puzzle knob 420*a*. All other directional pieces 200 can only be placed on the gameboard 400 by connecting with a directional piece 200 already on the gameboard 50 and can only be placed on a play space puzzle knob 420*b* located inside the gameboard border 54.

Figure 9:
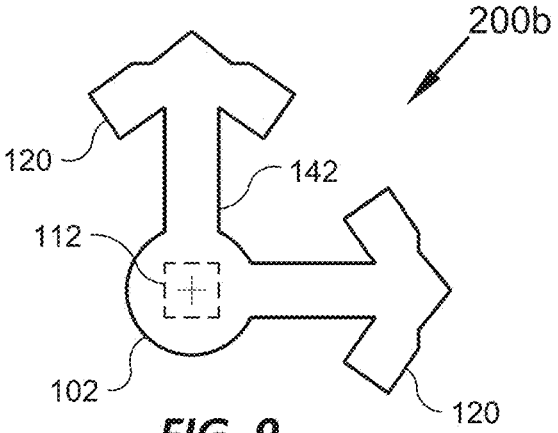
FIG. 9 is a top plan view of the '0–IN+2–OUT~OUT ONLY, SIDE BY SIDE' directional piece embodiment.

FIG. 9 is a top plan view of the embodiment described as '0–IN+2–OUT~CURVED' 200*b* directional piece consisting of a junction 102, two straight connectors 142 located 90 degrees from each other, sided by side, each connecting to an arrowhead 120.

Figure 10:
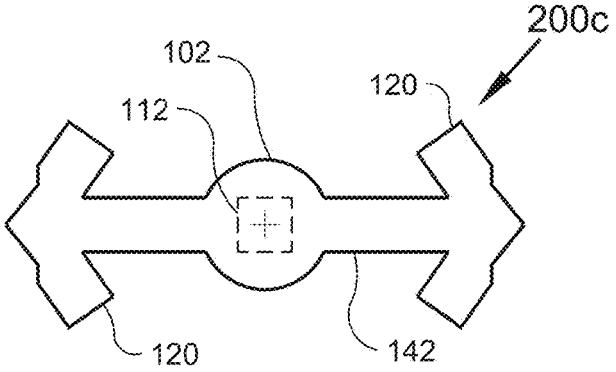
FIG. 10 is a top plan view of the '0–IN+2–OUT~OUT ONLY, STRAIGHT' directional piece embodiment.

FIG. 10 is a top plan view of the embodiment described as '0–IN+2-OUT~STRAIGHT' 200*c*, directional piece consisting of a junction 102, two straight connectors 142 located 100 degrees opposite from of each other, each connecting to an arrowhead 120.

Figure 11:
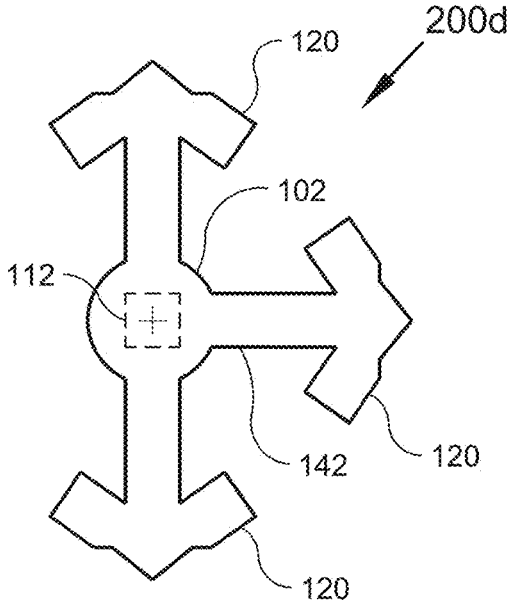
FIG. 11 is a top plan view of the '0–IN+3–OUT~OUT ONLY' directional piece embodiment.

FIG. 11 is a top plan view of the directional piece embodiment described as '0–IN–3–OUT~OUT ONLY' 200*d*, consisting of a junction 102, three straight connectors 142 located 90 degrees from each other on three sides of the junction, each connecting to an arrowhead 120.

Figure 12:
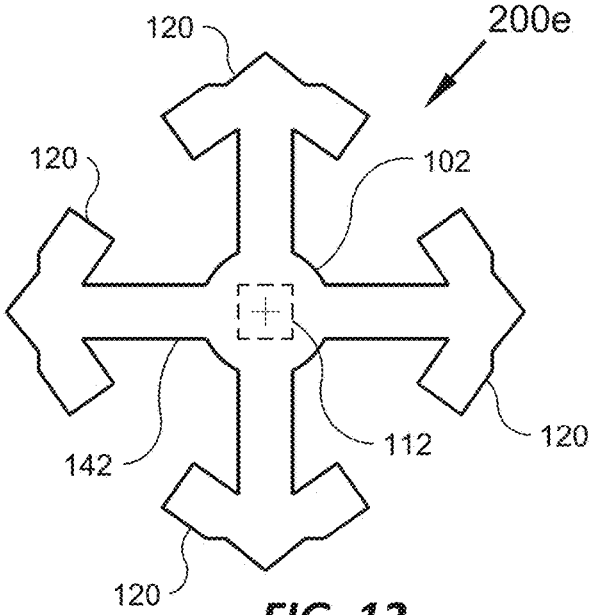
FIG. 12 is a top plan view of the '0–IN+4–OUT~OUT ONLY' directional piece embodiment.

FIG. 12 is a top plan view of the directional piece 200 embodiment described as '0–IN+4–OUT~OUT ONLY' 200*e*, consisting of a junction 102, four straight connectors 142 located 90 degrees from each other on four sides of the junction, each connecting to an arrowhead 120.

Figure 13:
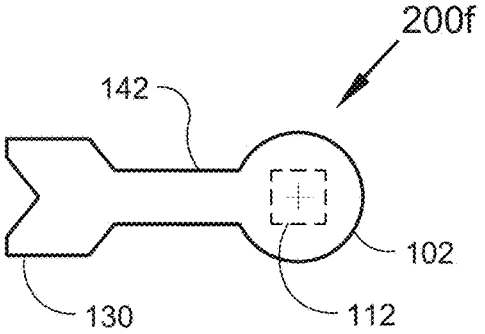
FIG. 13 is a top plan view of the '1–IN+0–OUT~END OF BOARD' directional piece embodiment.

FIG. 13 is a top plan view of the directional piece embodiment described as '1–IN+0–OUT~END OF PUZZLE' 200*f*, consisting of a junction 102 and a straight connector 142 with an arrowfeather 130. The 'END OF PUZZLE' 200*f* directional piece places second on the puzzle gameboard 400 and can be placed anywhere on an outside puzzle knob 420*a*.

Figure 14:
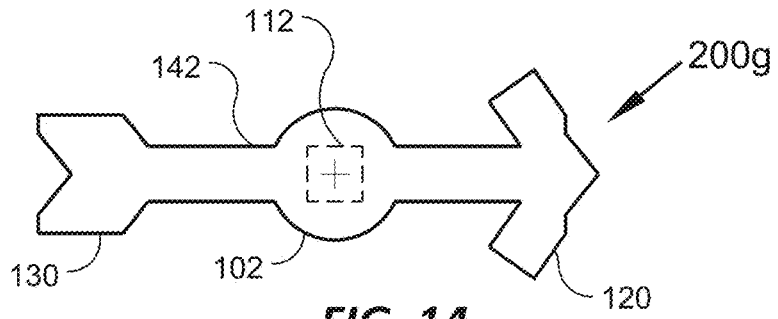
FIG. 14 is a top plan view of the '1–IN+1–OUT~STRAIGHT' directional piece embodiment.

FIG. 14 is a top plan view of the directional piece 200 embodiment described as '1–IN+1–OUT~STRAIGHT' 200*g* consisting of a junction 102, two straight connectors 142 located 100 degrees from each other on opposite sides of the junction 102, where one connects to an arrowhead 120, and one connects to an arrowfeather 130.

Figure 15:
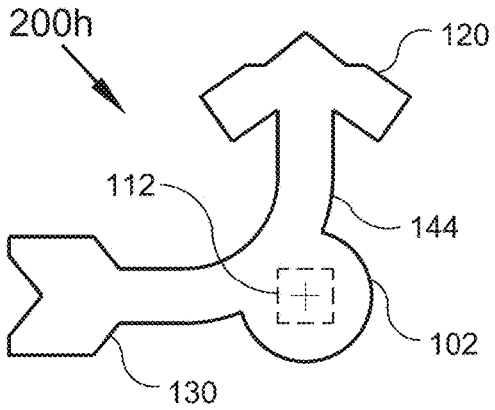
FIG. 15 is a top plan view of the '1–IN+1–OUT~CURVED LEFT' directional piece embodiment.

FIG. 15 is a top plan view of the directional piece embodiment described as '1–IN+1–OUT~CURVED LEFT' 200*h*, consisting of a junction 102, two curved connectors 144 located side by side of the junction 102 pointing left, where one connects to an arrowhead 120, and one connects to an arrowfeather 130.

Figure 16:
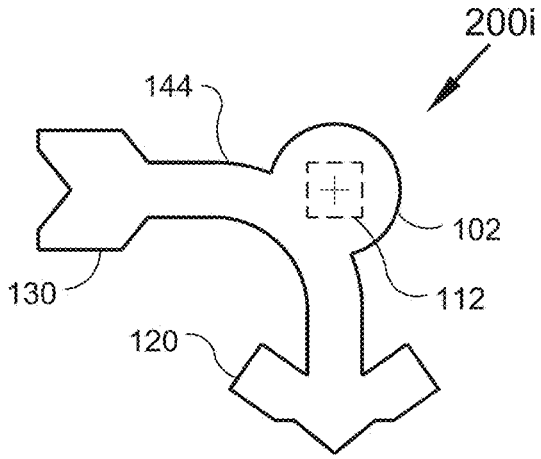
FIG. 16 is a top plan view of the '1–IN+1–OUT~CURVED RIGHT' directional piece embodiment.

FIG. 16 is a top plan view of the directional piece 200 embodiment described as '1–IN+1–OUT~CURVED RIGHT' 200*i*, consisting of a junction 102, two curved connectors 144 located side by side of the junction 102 pointing right, where one connects to an arrowhead 120, and one connects to an arrowfeather 130.

Figure 17:
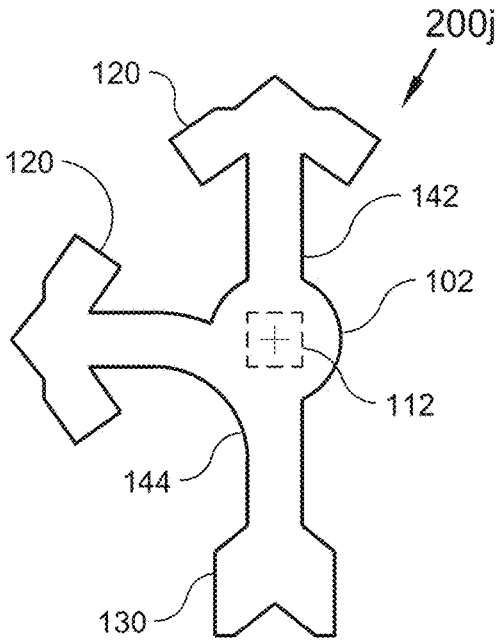
FIG. 17 is a top plan view of the '1–IN+2–OUT~STRAIGHT, CURVED LEFT' directional piece embodiment.

FIG. 17 is a top plan view of the directional piece 200 embodiment described as '1–IN+2–OUT~STRAIGHT, CURVED LEFT' 200*j*, consisting of a junction 102, one straight connector 142 and two curved connectors 144 located 90 degrees from each other side by side, with one pointing left. One straight connector 142 connects to an arrowfeather 130. The two curved connectors each connect to an arrowhead 120.

Figure 18:
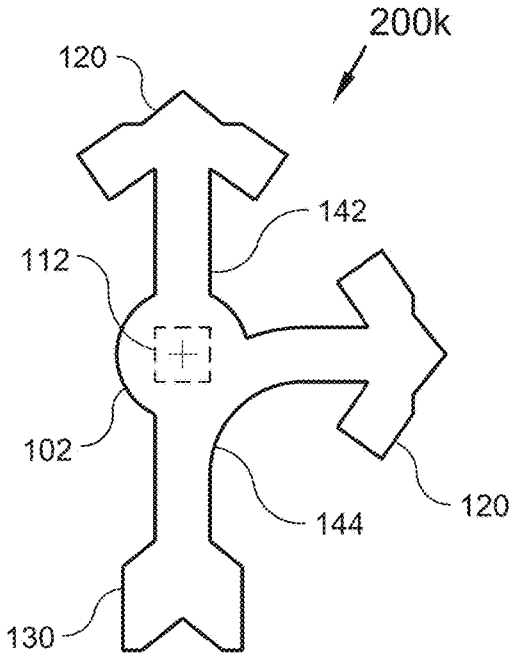
FIG. 18 is a top plan view of the '1–IN+2–OUT~STRAIGHT, CURVED RIGHT' directional piece embodiment.

FIG. 18 is a top plan view of the directional piece 200 embodiment described as '1–IN+2–OUT~STRAIGHT, CURVED, RIGHT' 200*k*, consisting of a junction 102, one straight connector 142 and two curved connectors 144 located 90 degrees from each other side by side, with one pointing right. One straight connector 142 connects to an arrowfeather 130. The two curved connectors 144 connect to an arrowhead 120.

Figure 19:
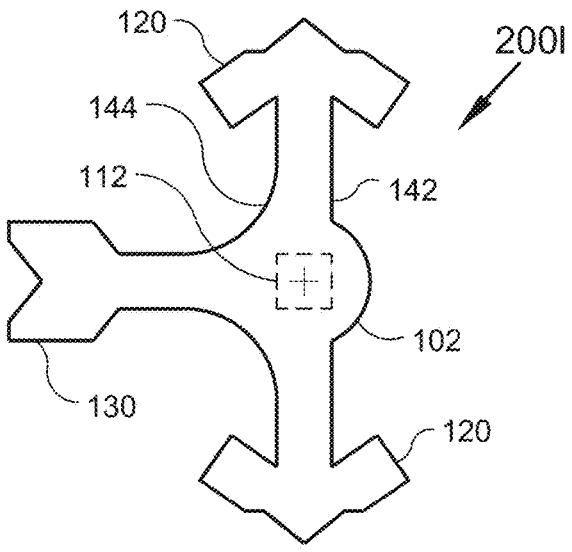
FIG. 19 is a top plan view of the '1–IN+2–OUT~STRAIGHT, SIDE BY SIDE' directional piece embodiments.

FIG. 19 is a top plan view of the directional piece 200 embodiment described as '1~IN+2-OUT~SIDE BY SIDE' 2001, consisting of a junction 102, one straight connector 142 and two curved connectors 144 located side by side, the straight connector 142 connects to an arrowfeather 130 and two curved connectors 144 each connect to an arrowhead 120.

Figure 20:
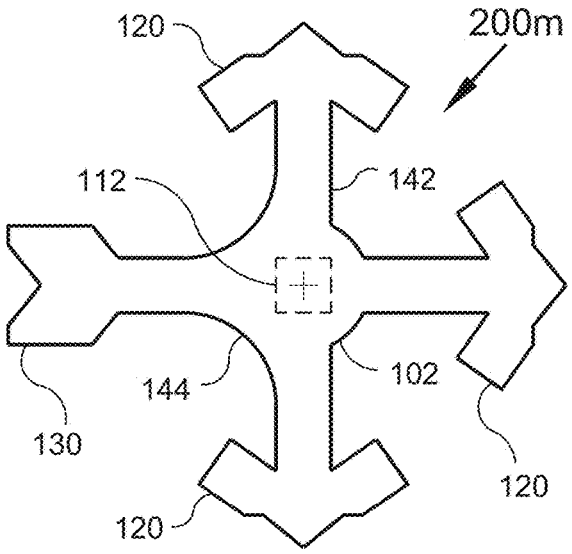
FIG. 20 is a top plan view of the '1–IN+3–OUT~STRAIGHT, CURVED, CURVED' directional piece embodiment.

FIG. 20 is a top plan view of the embodiment described as '1–IN+3–OUT~STRAIGHT, CURVED, CURVED' 200*m* directional piece consisting of a junction 102, one straight connector 142 connecting to an arrowfeather 130, and three curved connectors 144, each of which connect to an arrowfeather 130.

Figure 21:
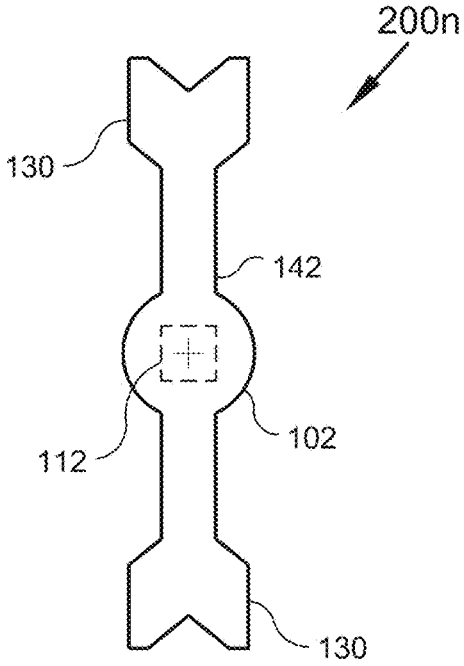
FIG. 21 is a top plan view of the '2–IN+0–OUT~DEAD–END, STRAIGHT' directional piece embodiment.

FIG. 21 is a top plan view of the directional piece 200 embodiment described as '2–IN+0–OUT~DEAD–END, STRAIGHT' 200*n*, consisting of a junction 102, two straight connectors 142 located on opposite sides of the junction 102, each of which connect to an arrowfeather 130.

Figure 22:
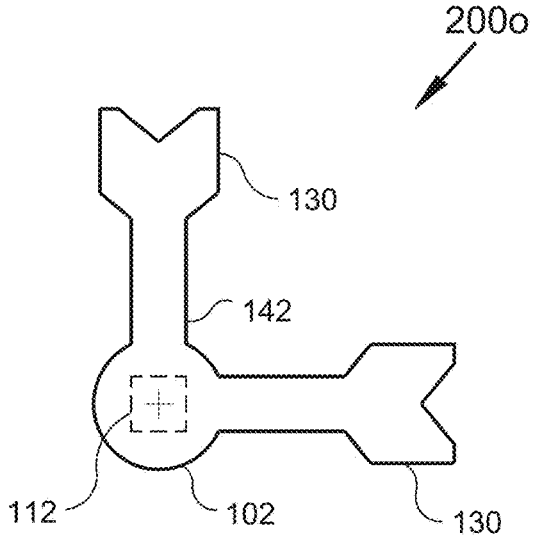
FIG. 22 is a top plan view of the '2–IN+0–OUT~DEAD–END, SIDE BY SIDE' directional piece embodiment.

FIG. 22 is a top plan view of the directional piece 200 embodiment described as '2–IN+0–OUT~DEAD–END, SIDE BY SIDE' 200*o*, consisting of a junction 102 and two straight connectors located side by side off the junction 102, each of which connect to an arrowfeather 130.

Figure 23:
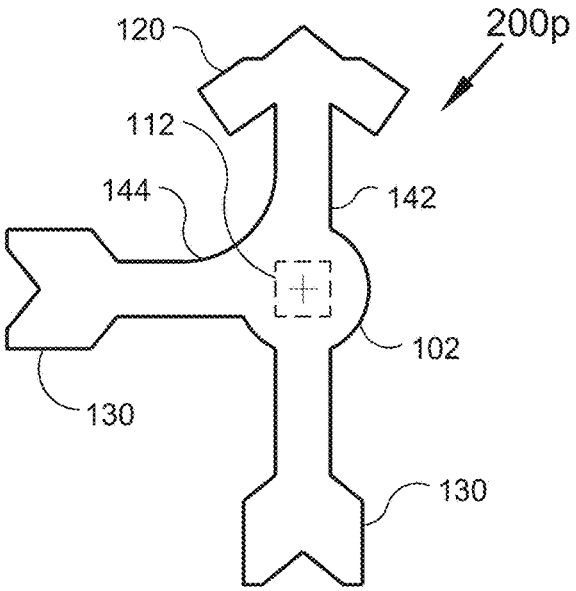
FIG. 23 is a top plan view of the '2–IN+1–OUT~STRAIGHT, CURVED LEFT' directional piece embodiment.

FIG. 23 is a top plan view of the directional piece 200 embodiment described as '2–IN+1–OUT~STRAIGHT, CURVED LEFT' 200*p*, consisting of a junction 102; two straight connectors 142, one with an arrowfeather 130 and one with an arrowhead 120; and one curved connector 144 with an arrowfeather 130, with each located on one of three sides of the junction 102.

Figure 24:
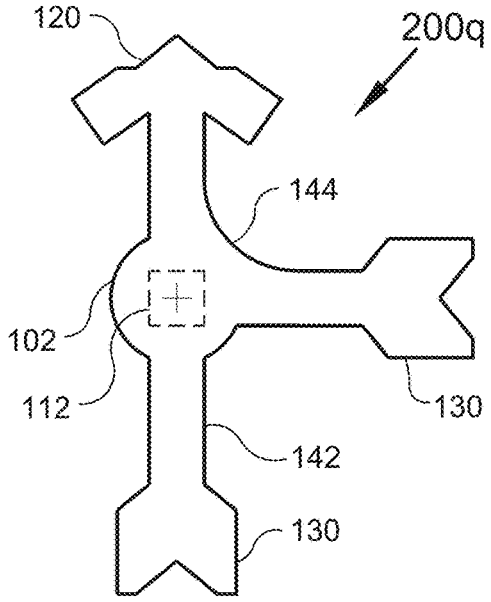
FIG. 24 is a top plan view of the '2–IN+1–OUT~STRAIGHT, CURVED RIGHT' directional piece embodiment.

FIG. 24 is a top plan view of the directional piece 200 embodiment described as '2–IN+1–OUT~STRAIGHT, CURVED RIGHT' 200*q*, consisting of a junction 102; two straight connectors 142, one with an arrowfeather 130 and one with an arrowhead 120; and one curved connector with an arrowfeather 130, with each located on one of three sides of the junction.

Figure 25:
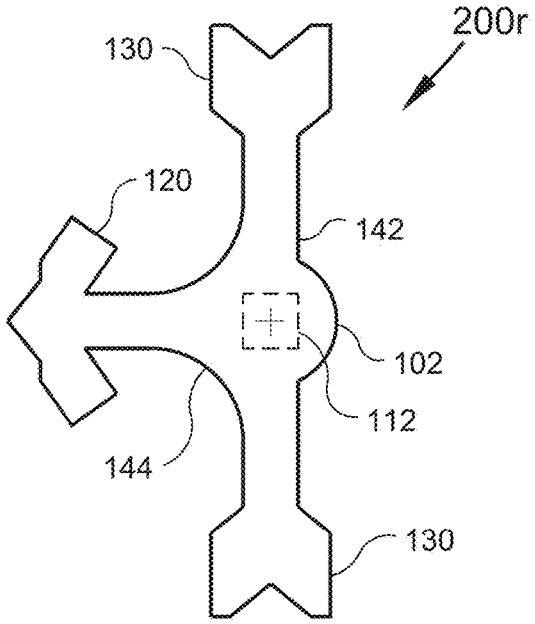
FIG. 25 is a top plan view of the '2–IN+1–OUT~STRAIGHT, STRAIGHT' directional piece embodiment.

FIG. 25 is a top plan view of the directional piece 200 embodiment described as '2–IN+1–OUT~STRAIGHT, STRAIGHT' 200*r*, consisting of a junction and three curved connectors 144, two with an arrowfeather 130 and one with an arrowhead 120, each located on one of three sides of the junction.

Figure 26:
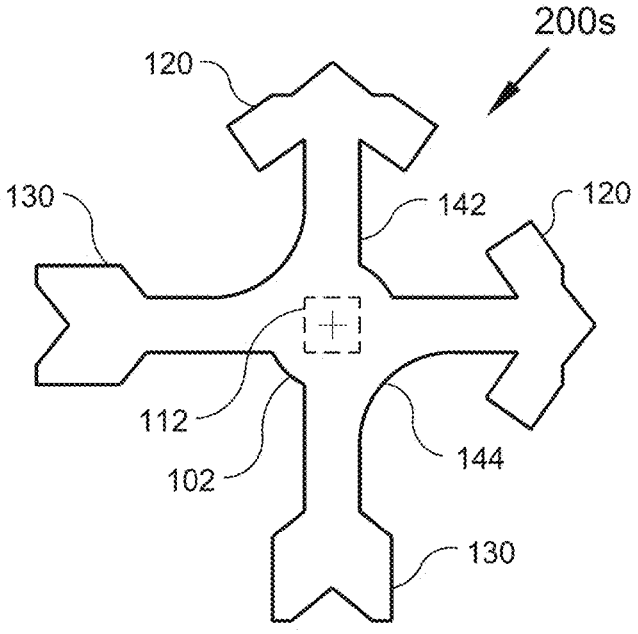
FIG. 26 is a top plan view of the '2–IN+2–OUT–SIDE BY SIDE' directional piece embodiment.

FIG. 26 is a top plan view of the directional piece 200 embodiment described as '2–IN+2–OUT~SIDE BY SIDE' 200*s*, consisting of a junction; two straight connectors 142, each with an arrowfeather 130; and two curved connectors 144, each with an arrowhead 120, all located 90 degrees from each other on one of the four sides of the junction.

Figure 27:
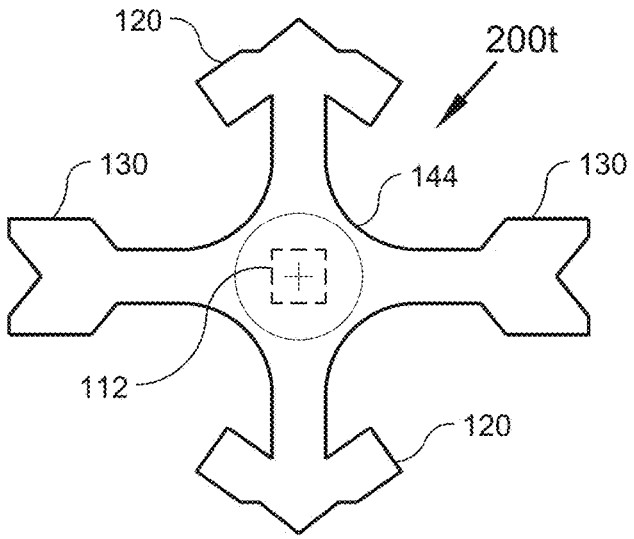
FIG. 27 is a top plan view of the '2–IN+2–OUT~OPPOSITE' directional piece embodiment.

FIG. 27 is a top plan view of the directional piece 200 embodiment described as '2–IN+2–OUT~OPPOSITE' 200*t*, consisting of a junction 102 and four curved connectors 144, two opposite from each other, each with an arrowfeather 130, and two opposite from each other, each with an arrowhead 120, each located 90 degrees from each other on one of four sides of the junction.

Figure 28:
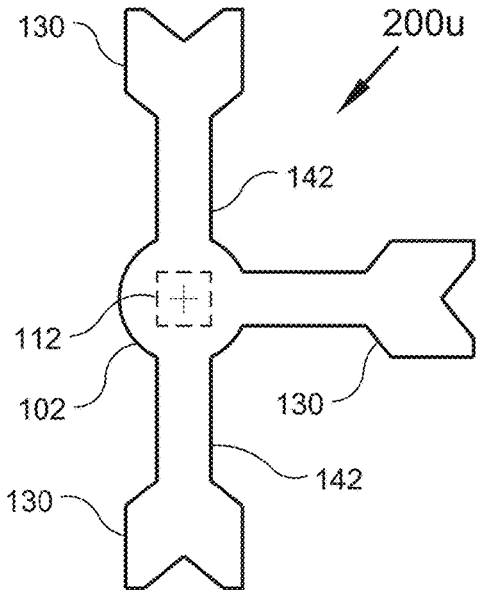
FIG. 28 is a top plan view of the '3–IN+0–OUT~DEAD–END, STRAIGHT' directional piece embodiment.

FIG. 28 is a top plan view of the directional piece 200 embodiment described as '3–IN+0–OUT~DEAD–END, STRAIGHT' 200*u*, consisting of a junction 102 and three straight connectors 142, each with an arrowfeather 130, all located 90 degrees from each other on one of three directions of the junction.

Figure 29:
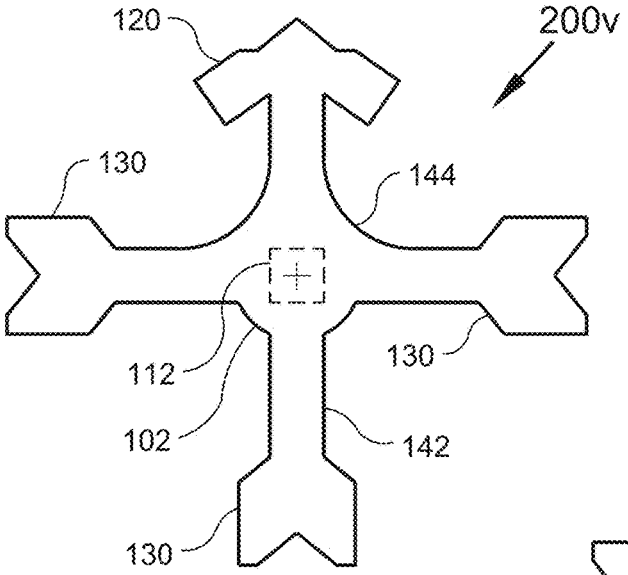
FIG. 29 is a top plan view of the '3–IN+1–OUT~STRAIGHT, CURVED, LEFT' directional piece embodiment.

FIG. 29 is a top plan view of the directional piece 200 embodiment described as '3–IN+1–OUT~STRAIGHT, CURVED, LEFT' 200*v*, consisting of a junction 102; three straight connectors 142, each with an arrowfeather 130; and one curved connector 144 with an arrowhead 120, with each located 90 degrees from each other on one of four sides of the junction.

Figure 30:
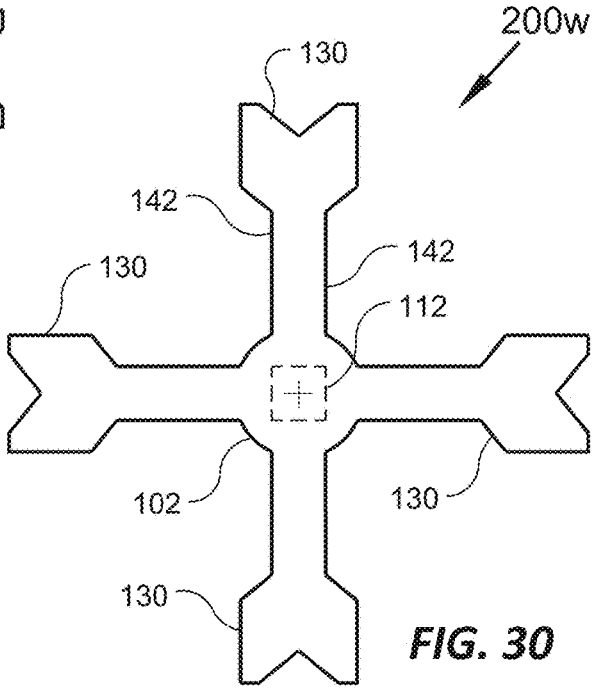
FIG. 30 is a top plan view of the '4–IN+0–OUT~DEAD–END' directional piece embodiment.

FIG. 30 is a top plan view of the directional piece 200 embodiment described as '4–IN+0–OUT~DEAD–END' 200*w*, consisting of a junction 102 and four straight connectors 142 each with an arrowfeather 130, with each located 90 degrees from each other on one of four sides of the junction.

Figure 34:
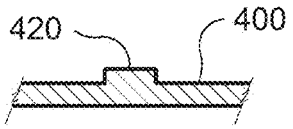
FIG. 34 is a section of the raised puzzle knob.
Figure 35:
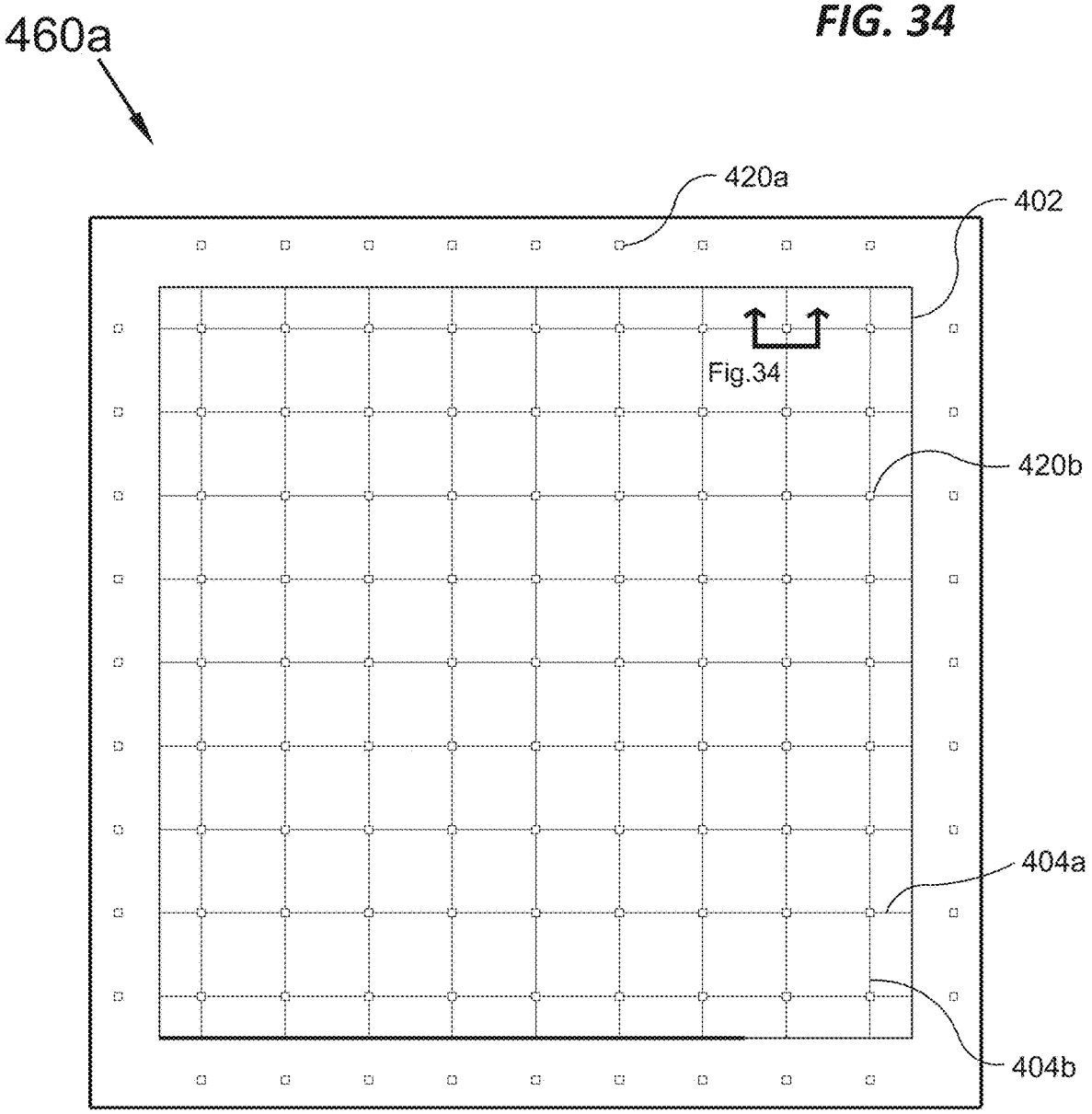
FIG. 35 is a top plan view of the front of the square-shaped, exemplary gameboard consisting of a play space with a geometric grid and raised puzzle knobs.
Figure 36:
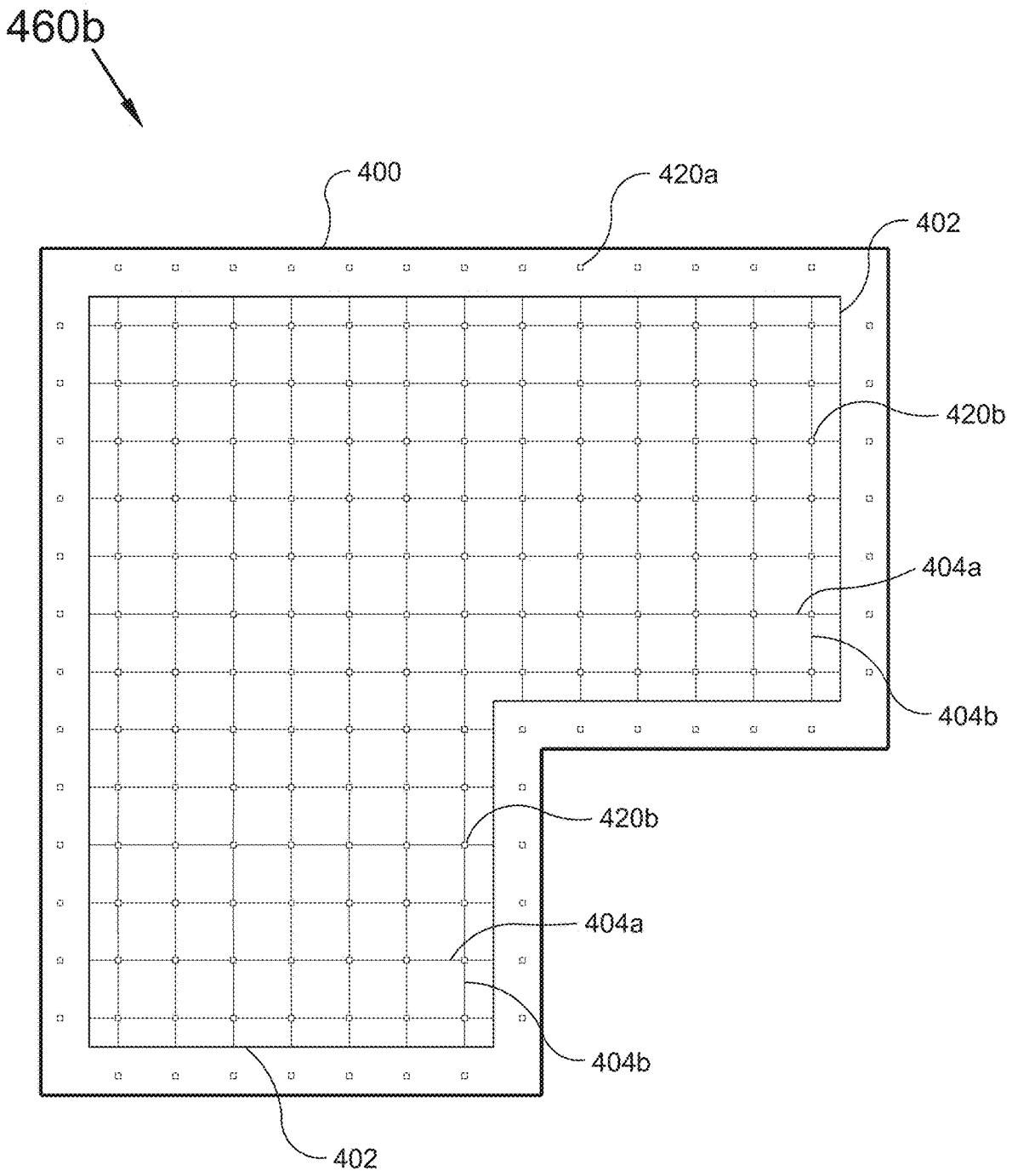
FIG. 36 is a top plan view of the front of the polygon-shaped, exemplary gameboard consisting of a play space with a geometric grid and raised puzzle knobs.

The gameboard 400 embodiment is multi-dimensional and configured to receive the plurality of two-dimensional directional pieces 200 as depicted in FIGS. 35 and 36. The puzzle gameboard 400 includes a gameboard border. Markings consist of a grooved solid boundary line 402 to define the play space 54 and internal grooved solid grid lines to create a geometric grid 60, both designed to be tactile by recessing the lines to assist those with limited visibility. The purpose of the geometric grid 404 on the gameboard 400 is to indicate the location of the puzzle knobs 420*b*, which is where the directional pieces 200 are positioned and to assist in aligning the plurality of directional pieces 200. FIG. 34 is a section view of the puzzle knob 420. Each gameboard 400 has the grid of puzzle knobs. FIG. 35 is a top plan view of the front of a sample puzzle gameboard 400 including a geometric grid 404 and variety of puzzle knobs 420. There are two types of puzzle knobs 420, outside puzzle knobs 420*a* and play space puzzle knobs 420*b*. Outside puzzle knobs 420*a* are around the perimeter, outside of the play space boundary line 402. Play space puzzle knobs 420*b* are located within the play space boundary line 402. The geometric grid 404 is created by a plurality of 90-degree recessed horizontal row lines 404*a* intersecting a plurality of 90-degree recessed vertical column lines 404*b*. Raised play space puzzle knobs 420*b* are located at the intersections of the horizontal and vertical grid lines. FIG. 35 is an example of the basic puzzle gameboard 400 embodiment, where the number of horizontal rows 404*a* equals the number of vertical columns 404*b*, creating a grid that has nine horizontal rows 404*a* and nine vertical columns 404*b*, which creates a matrix of eighty-one puzzle knobs 420*b*. FIG. 36 is an optional configuration of the gameboard 400 embodiment which includes additional grid lines where the number of horizontal rows is not equal to the number of vertical columns, and the grid lines can be of various lengths, creating an irregularly shaped gameboard 400 with various numbers of puzzle knobs 420*b*.

To play at the intermediate, advanced, and expert levels of expertise, there are two phases which utilize the gameboard 400, the directional pieces 200, the creatures 600 and the instruction cards 700, the measuring compass 800 and the dice 840. As described in FIG. 45's flowchart, players take turns in Phase One creating a puzzle pattern 500 by placing various directional pieces 200 on the puzzle gameboard 400, by connecting each directional piece 200 to one already on the board. The directional pieces 200 connect to each other end to end by aligning the notch of an arrowhead 120 to the notch of an arrowfeather 130. Phase Two is accomplished by migrating creatures 600 around the puzzle pattern 500 upon selection of an instruction card 700 which will direct a player to migrate their creature either by a 'MOVE' 720, a 'JUMP' 740, or a 'COMBO' 760 of actions or by the method described in an 'UT-OH' 780 card from the junction 102 of one directional piece 200 to the junction 102 of a different directional piece 200.

The first rule defines how the creature 600 can migrate contiguously around the puzzle pattern 500. Migrating contiguously occurs when a creature 600 can 'MOVE' 720 out from the junction 102 of their current location on the puzzle pattern 500 into the junction 102 of a different connecting directional piece 200. The second rule defines how a creature 600 can migrate around the gameboard 400 by a 'JUMP' 740 by leaving the colored junction 102 where the creature 200 is currently located and migrating to a similarly colored junction 102 of a different directional piece 200. The genius level of expertise consists of one phase and utilizes the gameboard 400 and the directional pieces 200.

Figure 31:
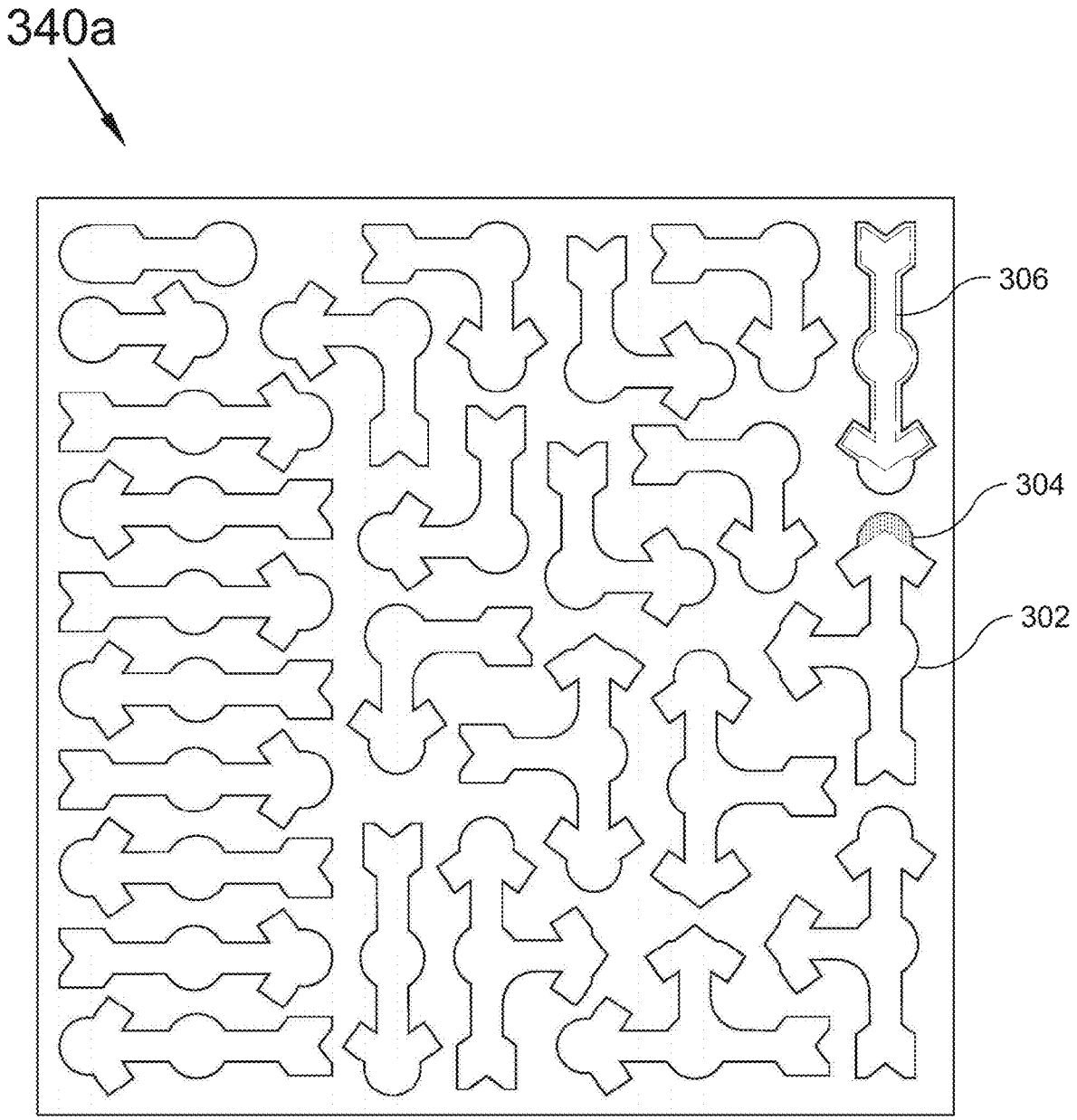
FIG. 31 is a top plan view of an organization tray embodiment.
Figure 32:
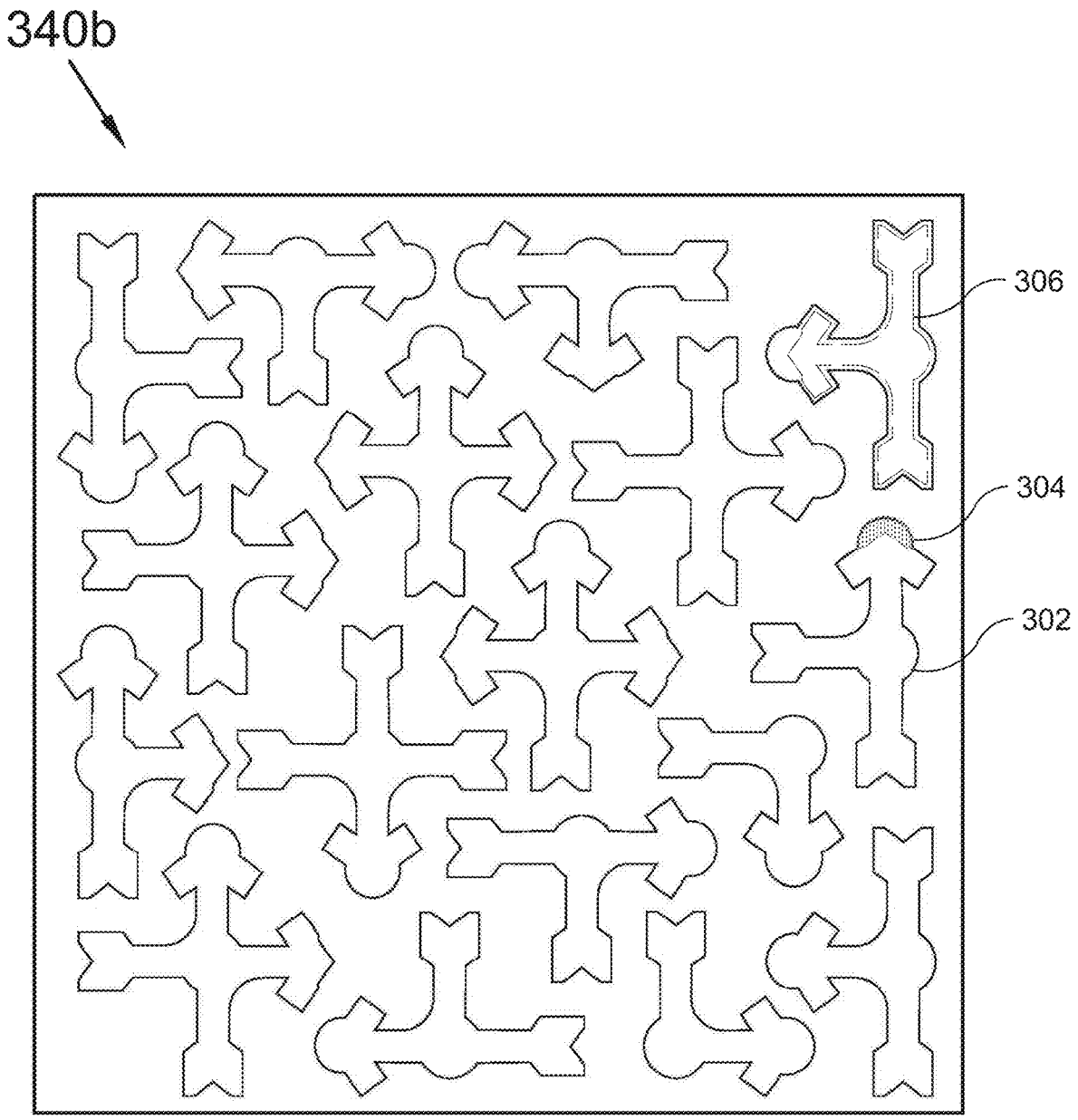
FIG. 32 is a top plan view of another organization tray embodiment.
Figure 33:
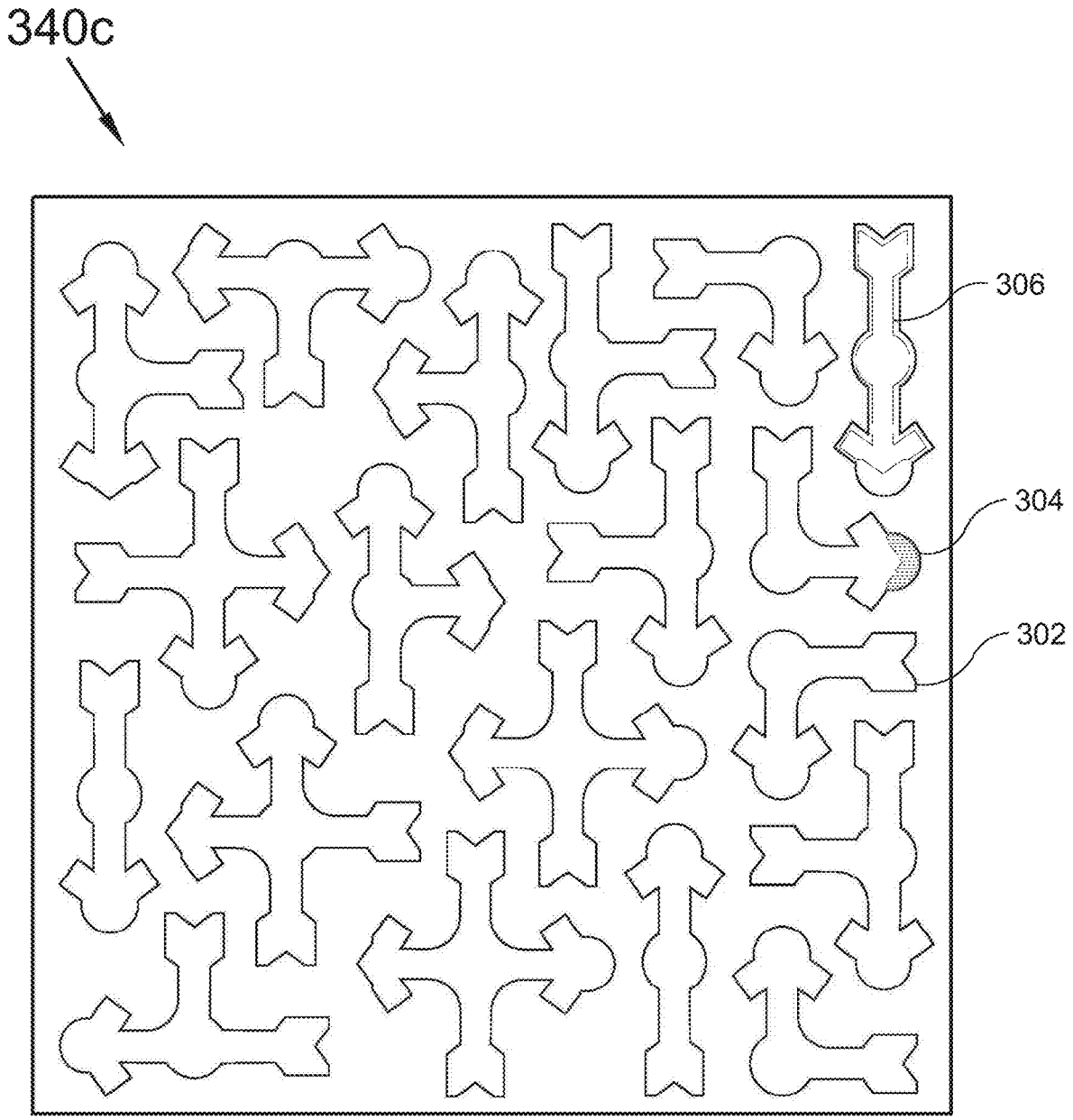
FIG. 33 is a top plan view of another organization tray embodiment.

FIGS. 31 through 33 are top plan views of organization tray 300 embodiments, each described as a dimensional board depicting openings 302 which represent a specific shape of a variety of directional pieces 200 and are offset from the size of the specific directional piece 200. Each opening is designed to receive the corresponding directional piece 200. One end of an opening 302 has a cutout 304 for ease of lifting out an individual directional piece 200. Combined, the organization trays hold a plurality of directional piece 200 embodiments, and each opening can have multiple layers of similar directional pieces 200 stacked on top of each other. There are different levels of play in a puzzle organization tray 300 each depending on the expertise level of the players. The levels include a beginner level, intermediate level, advanced level, expert level, and genius level.

Figure 37:
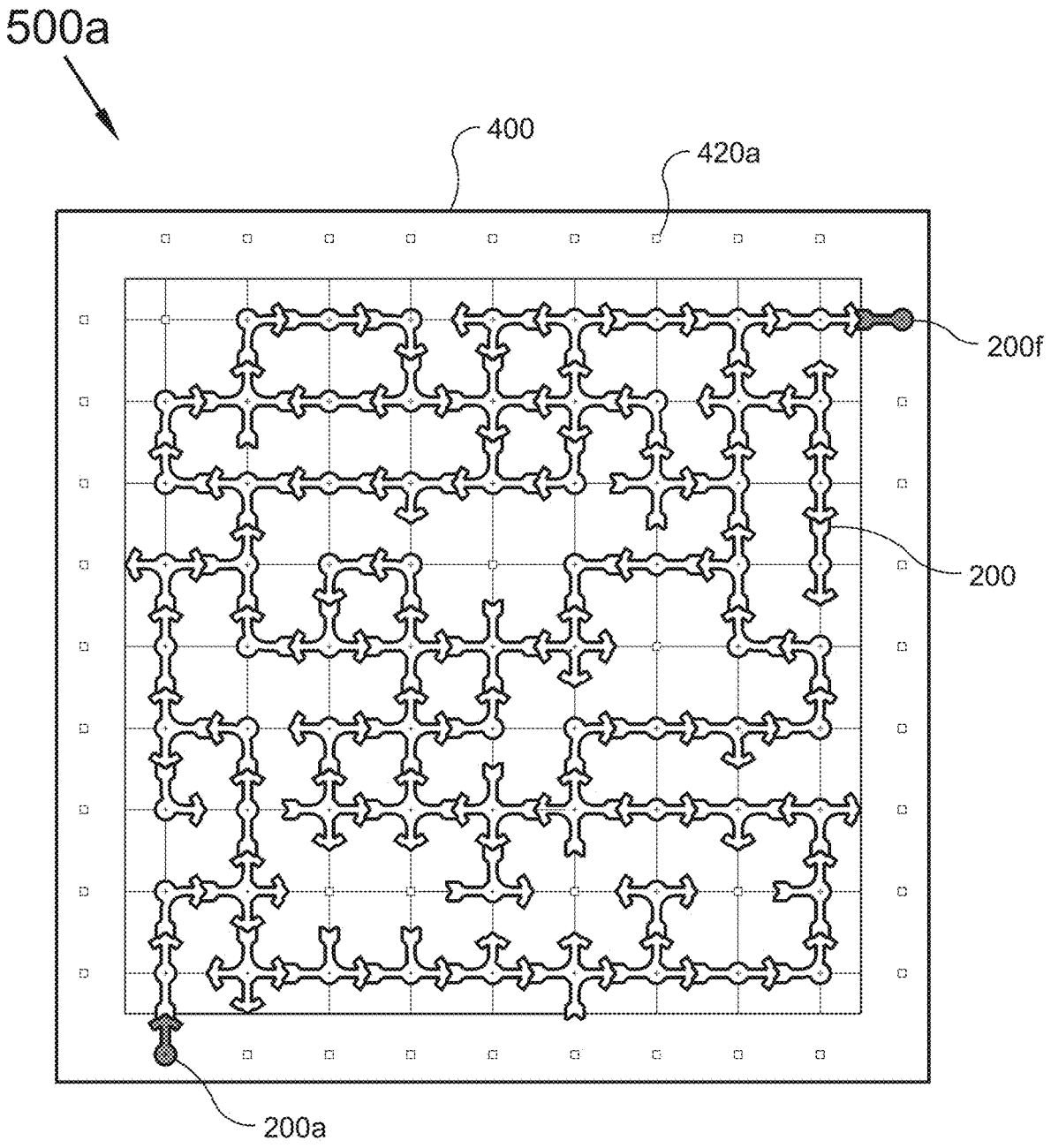
FIG. 37 is a top plan view of the puzzle gameboard embodiment with directional pieces arranged in a solved puzzle pattern.
Figure 38:
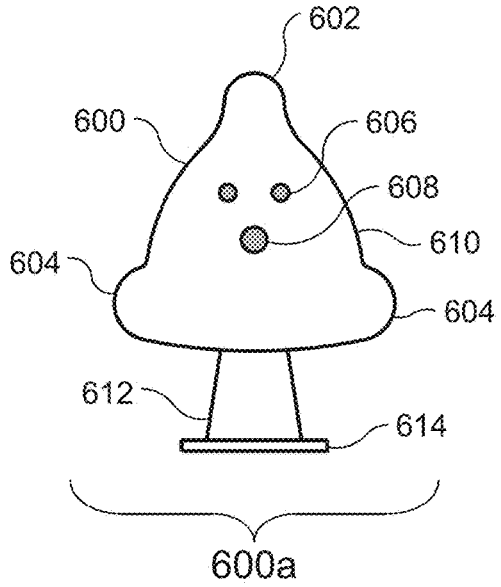
FIG. 38 is a front elevation view of the creature type A embodiment.
Figure 39:
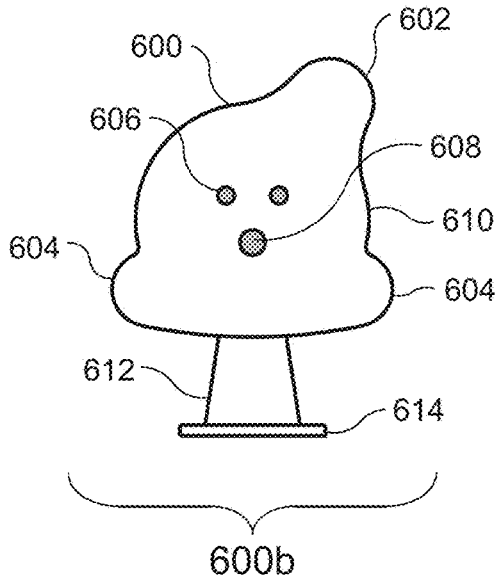
FIG. 39 is a front elevation view of the creature type B embodiment.
Figure 40:
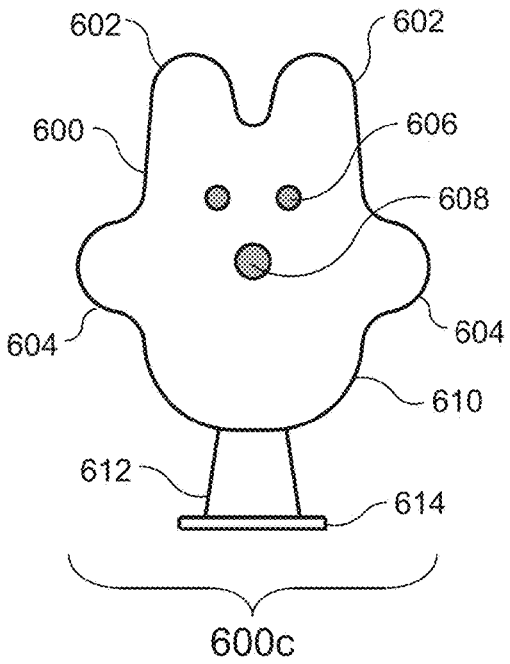
FIG. 40 is a front elevation view of the creature type C embodiment.
Figure 41:
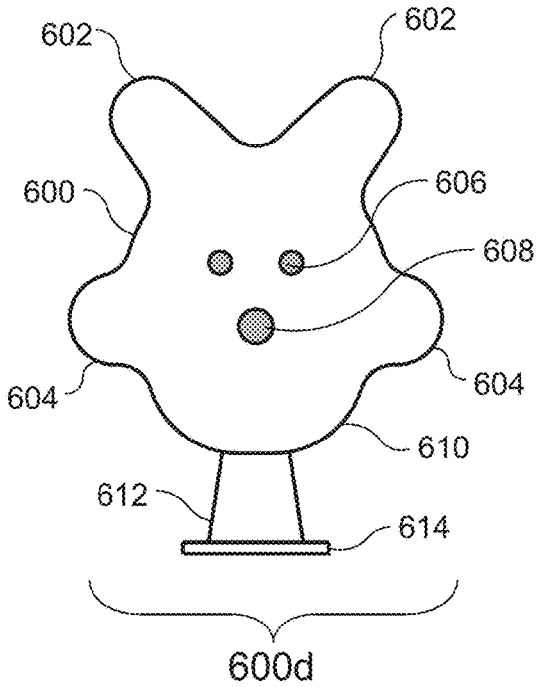
FIG. 41 is a front elevation view of the creature type D embodiment.

Configuring a puzzle pattern 500 occurs when the various directional pieces 200 are placed on the gameboard 400. Players create different puzzle patterns 500 dependent on the placement of the various directional pieces 200; puzzle pattern configuration 500 is created when the various directional pieces 200 are placed on the puzzle gameboard 400. FIG. 37 is a top plan view of a sample puzzle pattern. Different puzzle patterns 500 can be created by arranging the directional pieces in different configurations. The puzzle pattern 500 creates a path of travel for a creature 600 to migrate from the 'START OF PUZZLE' 200*a* directional piece to the 'END OF PUZZLE' 200*f* directional piece. Once a puzzle pattern 500 is created, not every puzzle pattern 500 will include a contiguous path of travel to migrate a player's creature 600 from the start to end of the puzzle pattern 500. In this situation, a 'JUMP' 740 instruction card will need to be drawn to continue to migrate around the puzzle pattern 500. A puzzle pattern 500 configuration can be played more than one time. The outcome will be different each time a specific pattern is played because of the order of instruction cards 700 drawn changes the path taken when there are various options within one puzzle pattern 500 or when jumping by color.

A creature 600 is a movable game piece used to migrate around the puzzle pattern 500. FIGS. 38 through 41 are front elevation views of various creatures 600. The creature shape 600 includes antennae 602, arms 604, eyes 606, mouth(s) 608, a body 610, a standing post 612, and a bottom base 614. For example, creature one 600*a* has one antenna 602 centered on top. Creature two 600*b* has one antenna 602 on the side pointing out sideways from the top. Creature three 600*c* has two antennae 602 on top. Creature four 600*d* has two antennae 602, one on each side pointing out sideways from the top. Creature 600 shapes may be other variations of antennae, arms, eyes, and mouths.

Figure 42:
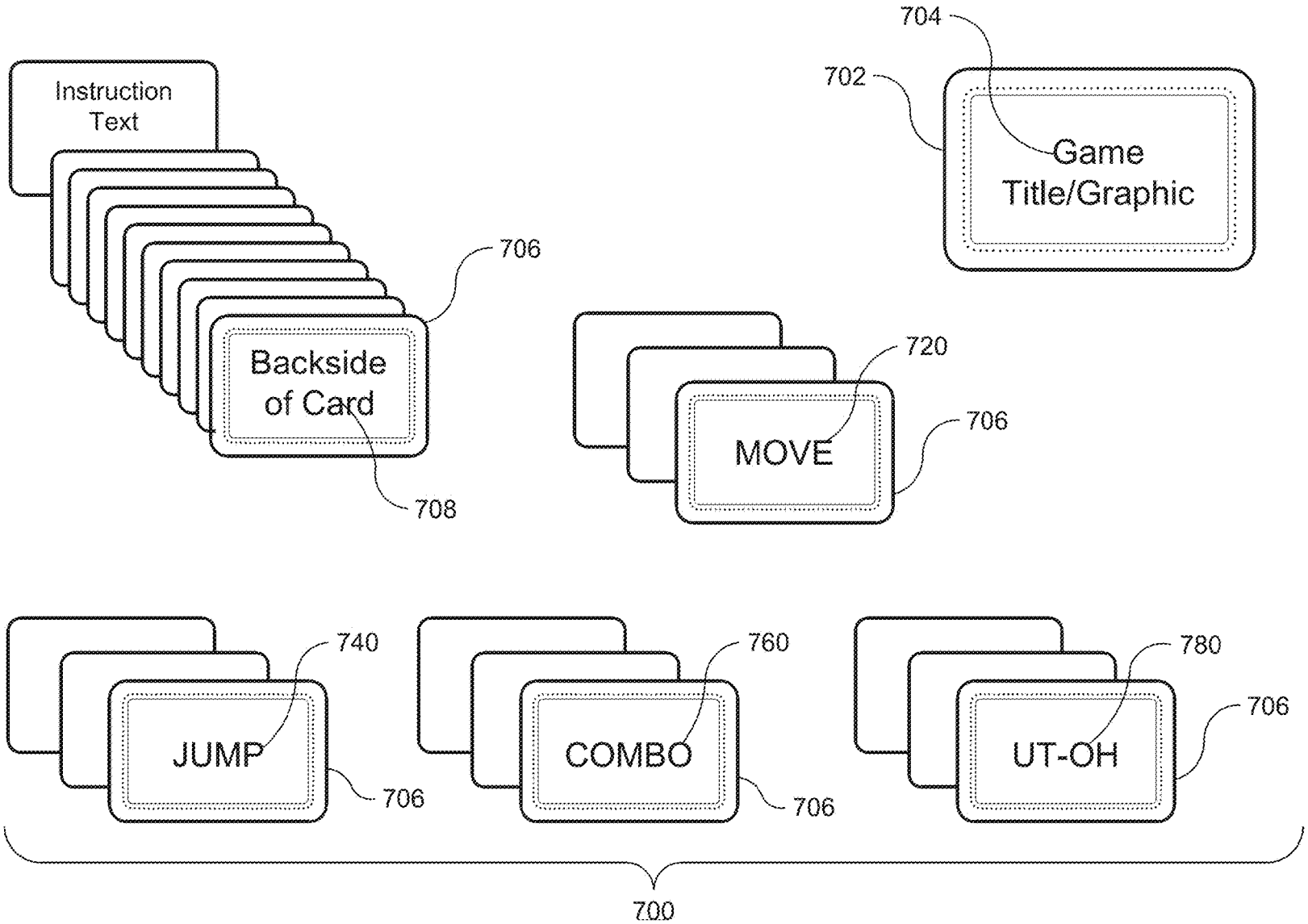
FIG. 42 is an isometric view of the plurality of the different types of instruction cards used in the game.
Figure 45:
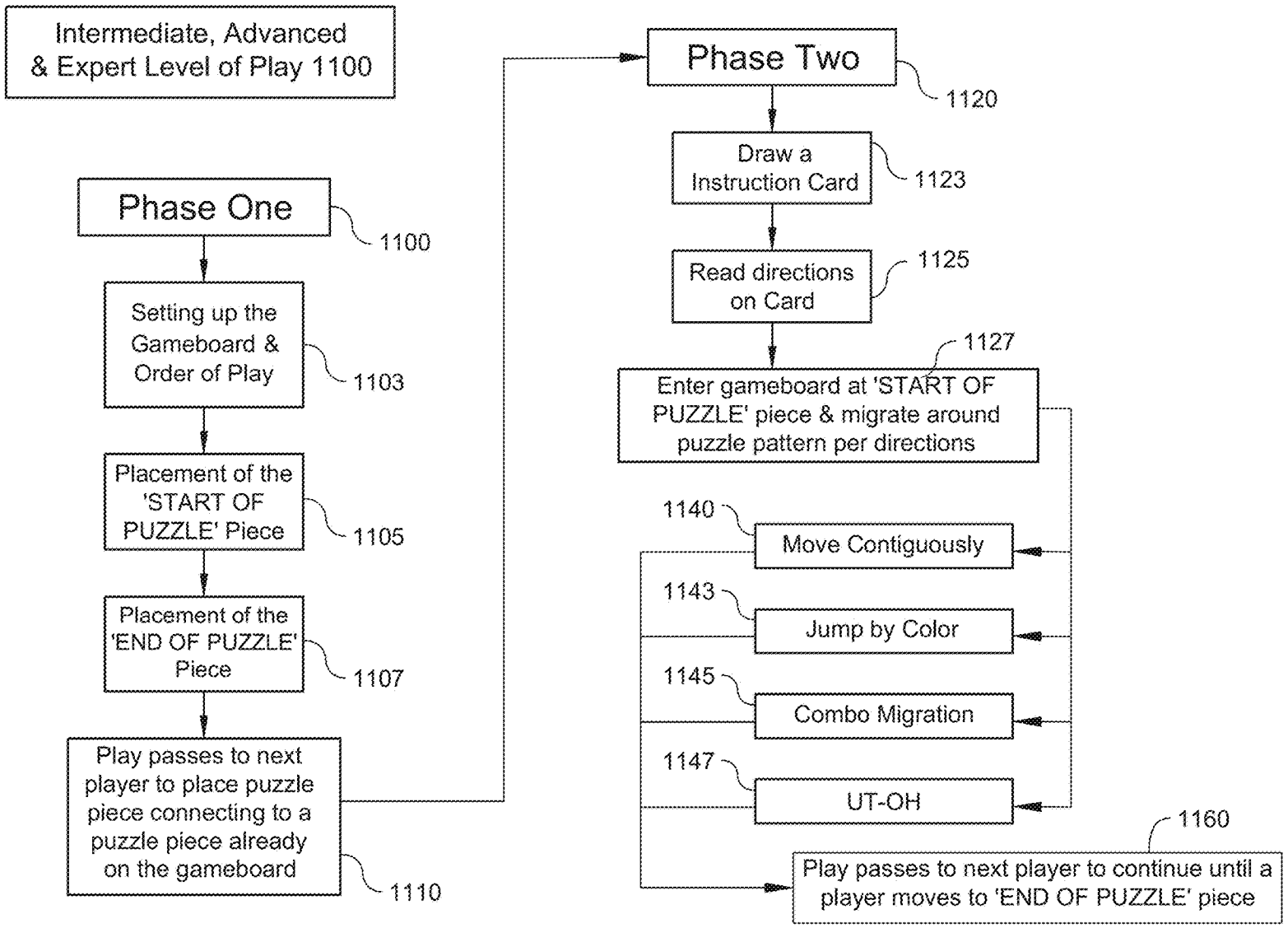
FIG. 45 is a flowchart describing the basic steps and phases in the intermediate, advanced, and expert levels of the method of play of the game.
Figure 46:
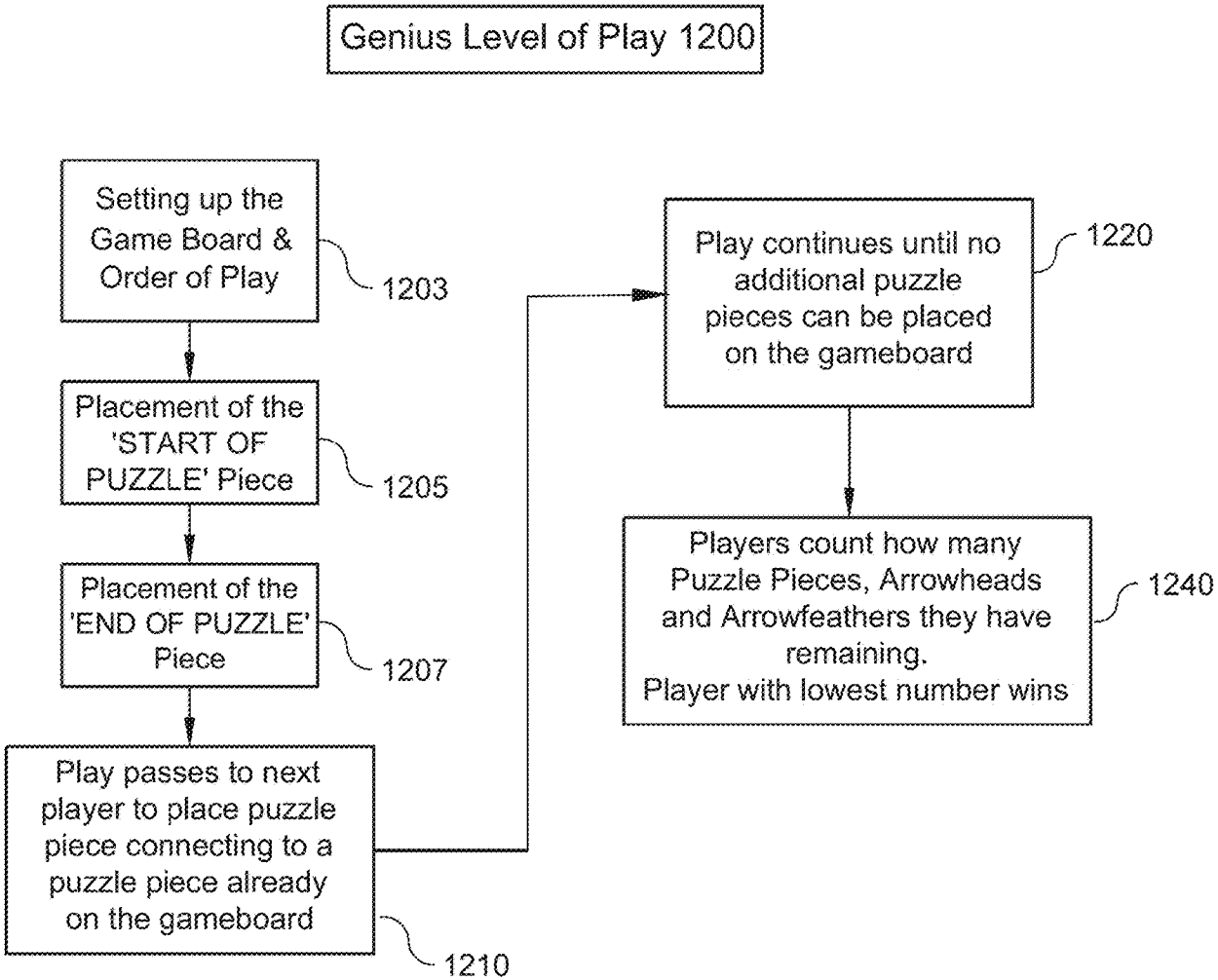
FIG. 46 is a flowchart describing the basic steps and phases in the genius level of the method of play of the game.

Instruction cards 700 provide direction regarding migrating creatures 600 around a puzzle pattern 500. FIG. 42 is an isometric view of the plurality of the different types of instruction cards used in the game. Referring to FIG. 42, the plurality of playing cards 700 have a front side 702 and a back side 706 and indicate a manner of how a creature 600 migrates around the puzzle pattern 500 from the start of puzzle 200*a* to the end of puzzle 200*f*. The front side of the card 702 identifies the format of the geometric multi-dimensional puzzle game. The back side of the playing card 706 comprises the action to be taken by a player during their turn, allowing them to migrate their creature 600 on the puzzle pattern 500. Each instruction card 700 has a different action to be taken during a player's turn. As shown in FIG. 42, the playing cards 700 are separated into four general groups: 'MOVE' contiguously 720, 'JUMP' by color 740, dual action moving 760, and miscellaneous actions 780. FIG. 45 is a flowchart describing the basic steps and methods to play the intermediate, advanced, and expert levels of the game. FIG. 46 is a flowchart describing the basic steps and methods to play the genius level of the game.

The first group of instruction cards 700 comprises a series of 'MOVE' 720 contiguously from one junction 102 to another junction 102, according to the instruction card 700 drawn. A plurality of directional pieces 200 provides only one option to 'MOVE' 720 contiguously, while another plurality of directional pieces 200 provide more than one option to 'MOVE' 720 contiguously. The 'MOVE' 720 contiguously cards comprise one or more 'MOVE' cards 720, direct the player to move their creature 600 contiguously from the current junction 102 on the directional piece 200 where they are stationed to a different junction 102. Most of the 'MOVE' cards 720 direct a player to 'MOVE' creatures 600 forward. Other options are to move forward, move forward to the left, move forward to the right, move backward, move backward to the left, or move backward to the right. Each 'MOVE' card 720 denotes how many junctions 102 to move between or to stay on the junction 102 where they are stationed.

The second group of instruction cards 700 comprises a series of cards that directs the player to 'JUMP' 740 from the current junction 102 the creature is located to a different junction 102 of the same color, according to the 'JUMP' card 740 drawn.

The third group of instruction cards 700 comprises a series of 'COMBO' 760, which are cards that first describe migrating the creature 600 of the player selecting the 'COMBO' 760 card and then describe migrating the creature 600 of another player.

The fourth group of playing cards 700 comprises a series of cards that tend to be negative actions. The 'UT-OH' 780 cards direct the player to make certain actions with a creature 600. They can include directing a player to not migrate during their turn, swap their creature 600 with that of any other players creatures 600, or migrate back to the 'START OF PUZZLE' 200*a*, according to the 'UT-OH' card 780 drawn.

The intermediate, advanced, and expert levels of play continue in the above manner with the subsequent players taking their turns sequentially as indicated in the steps in the flow charts of FIG. 45. The procedure continues until a player lands on the 'END OF PUZZLE' directional piece. For the genius level, play continues in the above manner with the subsequent players taking their turns sequentially as indicated in the steps in the flow charts of FIG. 46. Play continues until no more directional pieces can be placed on the gameboard 400.

Figure 43:
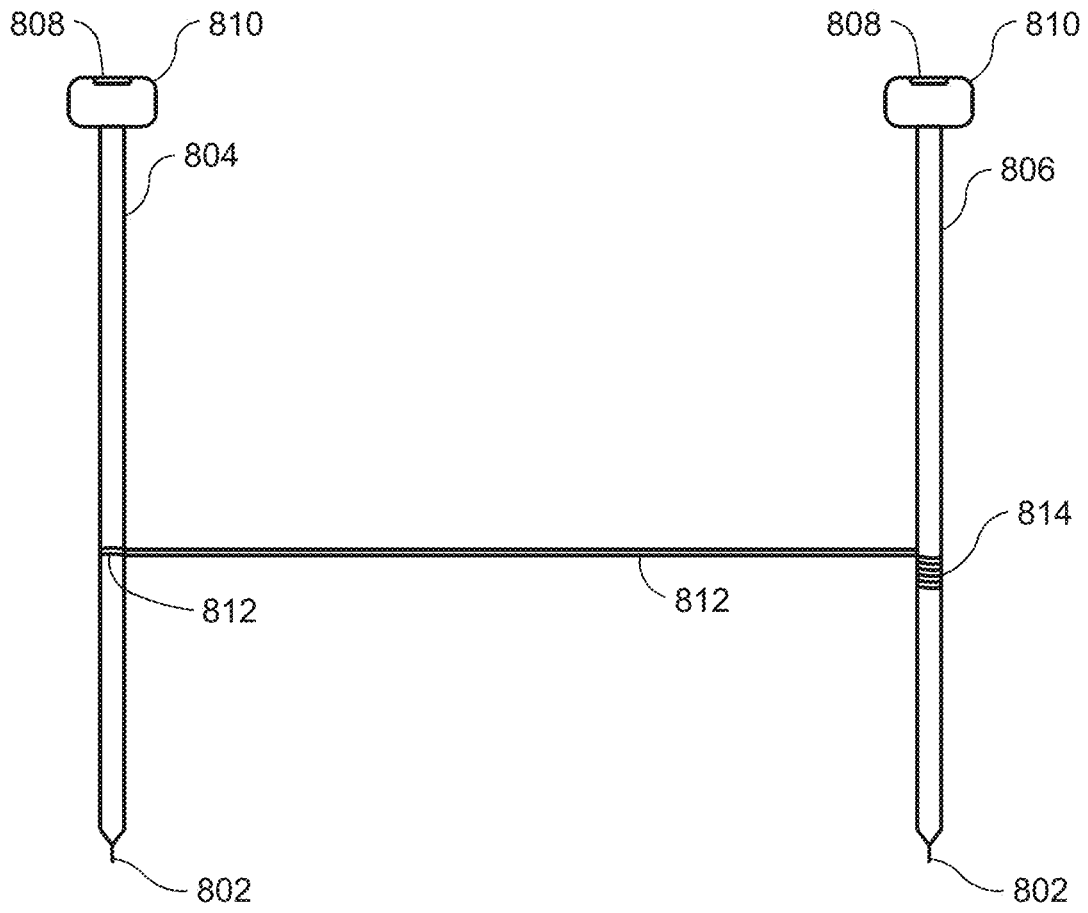
FIG. 43 is a side elevation view of the swing measuring compass embodiment.

When an instruction card drawn directs a player to 'JUMP' 740 from their current junction 102 to a different junction 102 of a similar color, it may not be obvious which colored junction is the closest or farthest from the creature's current location. Any player can challenge which colored spot is to be the creature's 600 new location after the 'JUMP' 740. The measuring compass 800 embodiment shown in FIG. 43 is utilized to determine the correct colored junction to 'JUMP' 740 their creature 600 to. The measuring point 802 on the stationary vertical post 804 is placed on the intersection of the crosshairs 104 on the current junction 102. Then, the measuring cord with the rotating vertical post 806 is extended to the crosshairs of a different junction of the same color. The rotating vertical post 806 is then placed on the new color junction and the cord is locked 816 to keep from extending any further. The player swings the rotating vertical post 806 to determine if there is any other colored spot closer. The leveling bubble on the top of the handle 808 can be used to ensure the vertical posts are plumb and level. This is helpful when two spots are very close to the same distance from the current junction where the creature 600 is located.

Figure 44A:
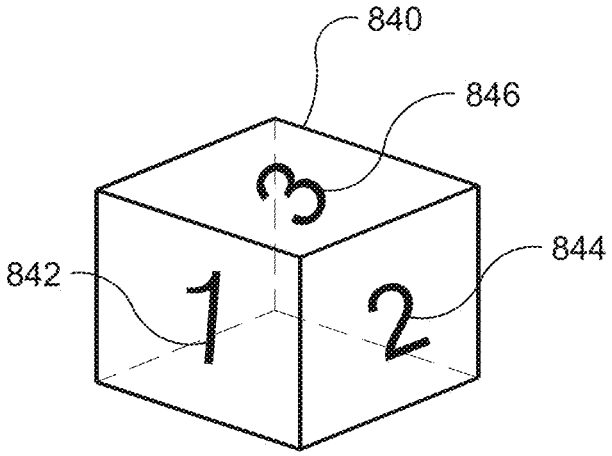
FIGS. 44*a* and 44*b* are isometric views of the die embodiment.
Figure 44B:
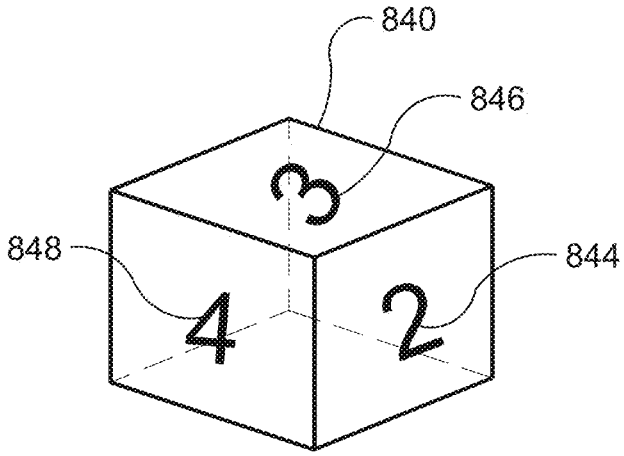

A single die 840 is utilized depending on the level of expertise of the game being played. As shown in FIGS. 44*a* and 44*b*, the die 840 is generally cubical, displaying indicia '1' 842 on one face, indicia '2' 844 on two opposing faces, indicia '3' 846 on two opposing faces, and indicia '4' 848 on one face opposite the indicia '1' 842. The single die 840 is mainly used for the beginner level in lieu of the playing cards to determine the number of junctions 102 a creature 600 is to move during a players turn. The die can also be used in intermediate, advanced, and expert expertise levels of play in conjunction with the instruction cards 700.

Flowcharts provide for an illustration of the basic steps in the method of play of the present game. FIG. 45 describes the intermediate, advanced, and expert levels of expertise play 1100. All embodiments of the present puzzle apparatus 50, whether using physical gaming apparatus or electronic play, utilize essentially the same method and procedures outlined in FIG. 45. Phase One is a set-up phase where the gameboard 400 is configured and the order of play determined among players 1103, as indicated in the flowchart in FIG. 45. Play begins with step 1105 where the first player places 'START OF PUZZLE' 200*a* piece anywhere on an outside knob 420*a* on the gameboard 400, and then in the next step 1107, the second player places the 'END OF PUZZLE' 200*f* piece on the gameboard 400. Play then passes to the next player 1110 to create the puzzle pattern by placing additional directional pieces 200 on the knobs 420*b* inside the play space 402. Once there are no more available play space knobs on which to add directional pieces 200, Phase Two begins 1120. Taking turns, each player draws 1123 an instruction card 700, reads the card 1125, and then moves their creature 600 as described, migrating around the puzzle pattern 500, either by a 'MOVE' contiguously 1140, a 'JUMP' by color 1143, a 'COMBO' of migrations 1145, or 'UT-OH' migrations 1147. Play passes 1160 to the next player to continue until a player lands on the 'END OF PUZZLE' piece and is declared the winner.

The genius expertise level is illustrated in flowchart 1200 in FIG. 46. Genius level only utilizes the directional piece 200 embodiments and the gameboard 400 embodiment of the present puzzle apparatus 50, whether using physical gaming apparatus or electronic play, utilizing essentially the same method and procedures outlined in FIG. 46. There is only one phase in the genius expertise level. Initially, the game starts with the configuring of the gameboard 400 and the order of play determined among players 1203, as indicated in the flowchart in FIG. 46. Play begins with step 1205 where the first player places the 'START OF PUZZLE' 200*a* piece anywhere on an outside knob 420*a* on the gameboard 400. Then in the next step 1207, the second player places the 'END OF PUZZLE' 200*f* piece on the gameboard 400. Play then passes to the next player 1210 to create the puzzle pattern by placing additional directional pieces 200 on the knobs 420*b* inside the play space 402. The goal is to be the player with the fewest directional pieces 200 remaining with the least amount of arrowheads 120 or arrowfeathers 130. Players are to strategically place directional pieces 200 while considering the implications of each directional piece 200 placed on the gameboard 400. Once there are no more available play space knobs 1220 on which to add a directional piece 200, players count 1240 their remaining pieces to determine the winner with the lowest score.

In conclusion, the present puzzle game in its various embodiments provides for interesting and educational entertainment for one, two, or more people who enjoy puzzles, games, and the like. The numerous embodiments provide several different devices that may be used for the present game, including electronic play. There are several variations on how to play with the various puzzle game embodiments. Regardless of the specific rules and methods of play, the present game provides entertaining and educational competition for all those involved.

It is to be understood that the present invention is not limited to the embodiments described above but encompasses any and all embodiments within the scope of the following claims.

The invention claimed is:

1. A system for playing a board game, comprising:

a game board, including:

a network of intersection points, wherein the network of intersection points is created by a plurality of intersecting recessed grooves in the game board; and raised knobs placed at the intersection points;

a directional piece for directing movement of a gameplay token, including:

a junction;

at least one of the following:

an outward-pointing directional indicator, which has a male connector pointing away from the junction that engages with a female connector of an inward-pointing directional indicator; or an inward-pointing directional indicator, which has a female connector pointing towards the junction that engages with a male connector of an outward-pointing directional indicator; and a connector that interfaces with a raised knob of the game board, limiting horizontal shifts of the directional piece across the game board; and a gameplay token capable of resting on the junction of a directional piece.

2. The system of claim 1, wherein an arrowhead is used as the outward-pointing directional indicator, or an arrowfeather is used as the inward-pointing directional indicator, and the arrowhead and arrowfeather connect end-to-end by aligning the point of an arrowhead with the notch of an arrowfeather.

3. The system of claim 1, wherein the connector of the directional piece comprises a female connector that engages with a male connector on the game board.

4. The system of claim 1, wherein the raised knobs of the game board are magnets, and the connector of the directional piece is a magnet that has an attraction to the raised knobs.

5. The system of claim 1, wherein the game board further includes:

a border surrounding the network of intersection points, with a raised knob at a point along the border where a directional piece connected to it could connect to a directional piece connected to a knob on the inside of the border.

* * * * *